US010286436B2

(12) United States Patent
Sumikawa et al.

(10) Patent No.: US 10,286,436 B2
(45) Date of Patent: May 14, 2019

(54) METHOD OF PRESS FORMING AND PRESS FORMING APPARATUS

(71) Applicant: JFE STEEL CORPORATION, Tokyo (JP)

(72) Inventors: Satoshi Sumikawa, Tokyo (JP); Akinobu Ishiwatari, Tokyo (JP); Jiro Hiramoto, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 499 days.

(21) Appl. No.: 14/896,229

(22) PCT Filed: Apr. 14, 2014

(86) PCT No.: PCT/JP2014/060624

§ 371 (c)(1),
(2) Date: Dec. 4, 2015

(87) PCT Pub. No.: WO2014/208181

PCT Pub. Date: Dec. 31, 2014

(65) Prior Publication Data

US 2016/0121384 A1 May 5, 2016

(30) Foreign Application Priority Data

Jun. 27, 2013 (JP) ..... 2013-134446
Jan. 30, 2014 (JP) ..... 2014-015730

(51) Int. Cl.
*B21D 22/02* (2006.01)
*B21D 22/10* (2006.01)
*B21D 22/26* (2006.01)

(52) U.S. Cl.
CPC ..... *B21D 22/02* (2013.01); *B21D 22/10* (2013.01); *B21D 22/26* (2013.01)

(58) Field of Classification Search
CPC ..... B21D 22/02; B21D 22/10; B21D 22/16; B21D 22/06; B21D 22/20; B21D 22/21; B21D 24/00; B21D 24/04
See application file for complete search history.

(56) References Cited

U.S. PATENT DOCUMENTS 7,234,336 B2 * 6/2007 Braun ..... B21D 22/02 72/379.6
2010/0018277 A1 * 1/2010 Hielscher ..... B21D 24/16 72/352

FOREIGN PATENT DOCUMENTS

CN 101486063 A 7/2009
CN 201333480 Y 10/2009
(Continued)

OTHER PUBLICATIONS

Jul. 15, 2014 Search Report issued in International Patent Application No. PCT/JP2014/060624.
(Continued)

*Primary Examiner* — Teresa M Ekiert
(74) *Attorney, Agent, or Firm* — Oliff PLC

(57) ABSTRACT

A method of press forming includes: forming a trench-shaped portion into a product shape with a die and a punch until reaching a first bottom dead center, and forms at least one of: a flange portion subject to shrink flange deformation such that a linear length of the flange portion subject to the shrink flange deformation in a longitudinal direction is shorter than a linear length of a flange portion in the product shape; and a flange portion subject to stretch flange deformation such that a linear length of the flange portion subject to the stretch flange deformation in the longitudinal direction is longer than the linear length of the flange portion in the product shape; and forming the formed flange portion into
(Continued)

the product shape with the die and a flange forming die until reaching a second bottom dead center.

16 Claims, 18 Drawing Sheets

(56) References Cited

FOREIGN PATENT DOCUMENTS

| | | | |
|---|---|---|---|
| CN | 202377323 | U | 8/2012 |
| DE | 101 28 199 | A1 | 12/2002 |
| JP | 2004-034145 | A | 2/2004 |
| JP | 4090028 | B2 | 5/2008 |
| JP | 2010-082660 | A | 4/2010 |
| JP | 2010-099700 | A | 5/2010 |
| JP | 2012-051005 | A | 3/2012 |
| WO | 2013/094705 | A1 | 6/2013 |

OTHER PUBLICATIONS

Jul. 25, 2016 Office Action issued in Chinese Patent Application No. 201480036579.5.
May 9, 2016 Extended Search Report issued in European Patent Application No. 14817881.7.
Mar. 13, 2017 Office Action issued in Chinese Patent Application No. 201480036579.5.

* cited by examiner (a)

(b)

(a)

(b)

METHOD OF PRESS FORMING AND PRESS FORMING APPARATUS

FIELD

The present invention relates to a method of press forming and a press forming apparatus that are used for forming a part to be formed in a product shape having a trench-shaped portion extending in the longitudinal direction and a flange portion that curves along the longitudinal direction on at least one of a pair of side wall portions that constitute the trench-shaped portion.

BACKGROUND

Press forming is a method of forming a blank to be press-formed by pressing a tool of press forming onto the blank to transfer the shape of the tool of press forming to the blank. The press forming gives, in some cases, after ejection of a press-formed part from the tool of press forming, rise to a drawback that the defect of shape caused by elastic recovery attributed to residual stress in the press-formed part, referred to as springback, occurs, and the shape of the press formed part varies from a desired shape.

The level of the springback to be generated is largely influenced by the strength of material in many cases. Recently, there has been an increasing tendency that the automotive industry particularly uses, in terms of the weight reduction of an automotive body, high-strength steel sheets for automotive body parts, and such high-strength steel sheets have increased the level of the springback to be generated. Accordingly, in order to bring the shape of the press-formed part after the springback occurs close to a design shape, the tool of press forming is required to be corrected many times by a skilled hand in a production site while repeating trial and error. As a result, the period of production is prolonged. Therefore, it is reasonable to say that the development of a method of effectively reducing the springback is a still more important task also in reducing the development period and cost of an automotive.

In reducing the springback, the control of the stress by which the springback is caused is indispensable. As a method that controls the stress to reduce the springback, for example, Patent Literature 1 discloses "PRESS-FORMING DIE APPARATUS OF STEEL SHEET." The method described in Patent Literature 1 is a method of press-forming, in crash-forming a hat-shaped section part, the hat-shaped section part with a tool of press forming in which a projecting bead is formed in a flange portion. In this method, a blank is locked by the projecting bead immediately before a bottom dead center so as to impart tensile deformation to a side wall portion of the blank thus eliminating a stress difference in the thickness direction of the blank, the stress difference being a cause of the curl of the side wall portion.

Furthermore, as another example, there has been proposed a method of press-forming a blank with a tool of press forming that has a blank holder with a recess arranged on the periphery of a punch, in Patent Literature 2. In this method, a blank end is entered into the recess of the blank holder while press-forming and thereafter, the blank end abuts on an inner wall of the recess to be confined to the recess. Accordingly, the blank stops protruding out of the recess thus imparting in-plane compressive stress to a side wall portion of the blank immediately before a bottom dead center and eliminating a stress difference in the thickness direction of the blank.

CITATION LIST

Patent Literature

Patent Literature 1: Japanese Patent No. 4090028

Patent Literature 2: Japanese Laid-open Patent Publication No. 2010-99700

SUMMARY

Technical Problem

In the method described in Patent Literature 1, a bead-shaped portion remains in the flange portion of a part press-formed thus giving rise to a possibility that a trouble occurs at the time of welding the part to other parts in an assembly process. Accordingly, it is necessary to cut away a portion in which the bead-shaped portion remains, or extend the blank in an elongated manner so as to prevent the bead-shaped portion from remaining in a product.

Furthermore, the respective methods described in Patent Literatures 1 and 2 are intended to a countermeasure to a shape change that occurs in a certain cross section by the springback. However, in actual parts, there has been a drawback of three-dimensional springback such as torsion or bending, which arises in an entire part, in many cases, and the respective methods described in Patent Literatures 1 and 2 cannot be sufficient countermeasures against such a drawback.

The present invention has been made to overcome such drawbacks, and it is an object of the present invention to provide a method of press forming and a press forming apparatus that are capable of reducing three-dimensional springback, such as torsion or bending, without changing a product shape.

Solution to Problem

A method of press forming according to the present invention forms a formed part in a product shape including a trench-shaped portion extending in a longitudinal direction, and a flange portion, curving along the longitudinal direction, on at least one of a pair of side wall portions that constitute the trench-shaped portion, and includes: a first forming step of forming the trench-shaped portion into the product shape with a die and a punch until reaching a first bottom dead center, and forms at least one of: a flange portion subject to shrink flange deformation such that a linear length of the flange portion subject to the shrink flange deformation in the longitudinal direction is shorter than a linear length of the flange portion in the product shape; and a flange portion subject to stretch flange deformation such that a linear length of the flange portion subject to the stretch flange deformation in the longitudinal direction is longer than the linear length of the flange portion in the product shape; and a second forming step of forming the flange portion formed in the first forming step into the product shape with the die and a flange forming die until reaching a second bottom dead center, wherein the first forming step and the second forming step are performed by a single press forming process.

In the above-described method of press forming according to the present invention, the second forming step brings the die and the punch close to the flange forming die while the die and the punch hold the trench-shaped portion at the first bottom dead center, in a state that a part of the flange portion abuts on the flange forming die.

In the above-described method of press forming according to the present invention, the second forming step stops the die and the punch while the die and the punch hold the trench-shaped portion at the first bottom dead center, and brings the flange forming die close to the die side.

In the above-described method of press forming according to the present invention, the first forming step and the second forming step are applied to the flange portion on either one of the pair of side wall portions.

In the above-described method of press forming according to the present invention, the first forming step and the second forming step are applied to the flange portions on the pair of side wall portions.

In the above-described method of press forming according to the present invention, when a press-formed part including a punch bottom portion is formed, a part corresponding to the punch bottom portion in a blank is pressed with a pad to perform the first forming step and the second forming step.

A press forming apparatus according to the present invention forms a formed part in a product shape including a trench-shaped portion extending in a longitudinal direction, and a flange portion, curving along the longitudinal direction, on at least one of a pair of side wall portions that constitute the trench-shaped portion, and includes: a die including a recessed portion and flange forming portions on both sides of the recessed portion; a punch whose upper portion is inserted into the recessed portion of the die; and a flange forming die configured to form the flange portion in cooperation with the flange forming portions of the die, wherein the punch is set in the flange forming die in a relatively movable manner and supported with a support mechanism so that the punch is configured to move relative to the flange forming die at a time a predetermined pressure is applied to the punch, the punch is supported with the support mechanism at a predetermined height above the flange forming die and in this state, the upper portion of the punch is inserted into the recessed portion of the die to form the trench-shaped portion, and the die is configured to move by a force larger than a support force of the support mechanism that supports the punch while holding the trench-shaped portion with the die and the punch to form the flange portion with the die and the flange forming die.

A press forming apparatus according to the present invention forms a formed part in a product shape including a trench-shaped portion extending in a longitudinal direction, and a flange portion, curving along the longitudinal direction, on at least one of a pair of side wall portions that constitute the trench-shaped portion, and includes: a die including a recessed portion and flange forming portions on both sides of the recessed portion; a punch whose upper portion is inserted into the recessed portion of the die; and a flange forming die configured to form the flange portion in cooperation with the flange forming portions of the die, wherein the punch is set in the flange forming die in a relatively movable manner and supported with a support mechanism so that the punch is configured to move relative to the flange forming die at a time a predetermined pressure is applied to the punch, the punch is supported with the support mechanism at a predetermined height above the flange forming die and in this state, the upper portion of the punch is inserted into the recessed portion of the die to form the trench-shaped portion, and the flange forming die is moved while holding the trench-shaped portion with the die and the punch to form the flange portion with the die and the flange forming die.

In the above-described press forming apparatus according to the present invention, a condition such that $0.05<h/L<1.0$ is satisfied, where h indicates a relative moving distance of the punch with respect to the flange forming die and L indicates a flange width of the product shape.

In the above-described press forming apparatus according to the present invention, the flange forming die forms the flange portion on either one of the pair of side wall portions.

In the above-described press forming apparatus according to the present invention, the flange forming die forms the flange portions on the pair of side wall portions.

In the above-described press forming apparatus according to the present invention, the press forming apparatus includes a pad that sandwiches a part of the blank in cooperation with the punch.

Advantageous Effects of Invention

According to the present invention, it is possible to reduce residual stress that arises in a flange portion thus reducing three-dimensional springback, such as torsion or bending, without changing a product shape.

DESCRIPTION OF EMBODIMENTS

Figure 14:
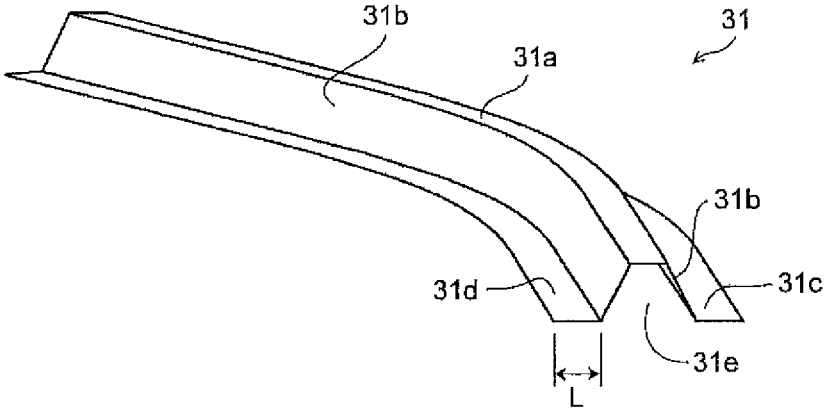
FIG.14 (RELATED ART)
FIG. 14 is an explanatory view of a task of the present invention and is a perspective view of a press-formed part formed by a conventional method of press forming.

In order to complete the above-mentioned tasks, the inventors of the present invention examined modes of springback occurred in a formed part 31 crash-formed, the formed part 31 being, as illustrated in FIG. 14, constituted of a trench-shaped portion 31*e* composed of a punch bottom portion 31*a* and side wall portions 31*b*, and a flange portion (outer flange 31*c* and inner flanges 31*d*) that curves along the longitudinal direction.

Figure 15:
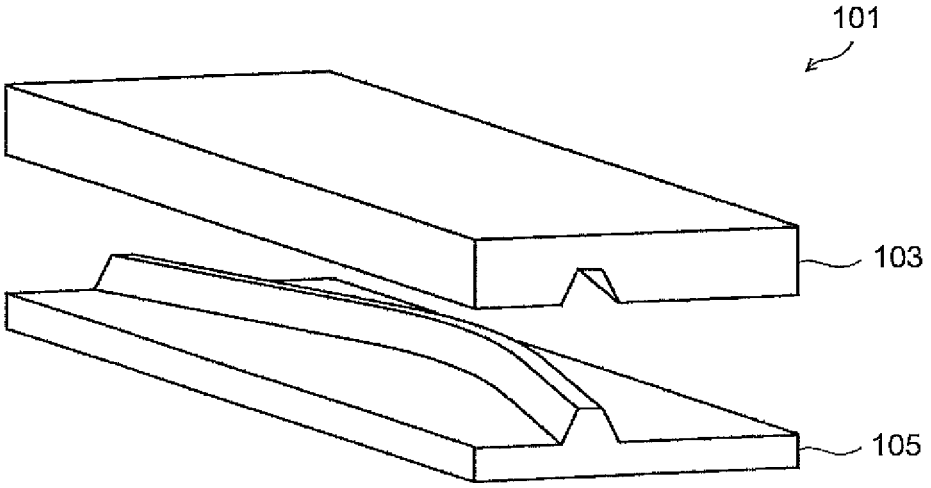
FIG.15 (RELATED ART)
FIG. 15 is an explanatory view of a task of the present invention and is a perspective view of a tool of press forming of a conventional press forming apparatus.
Figure 16:
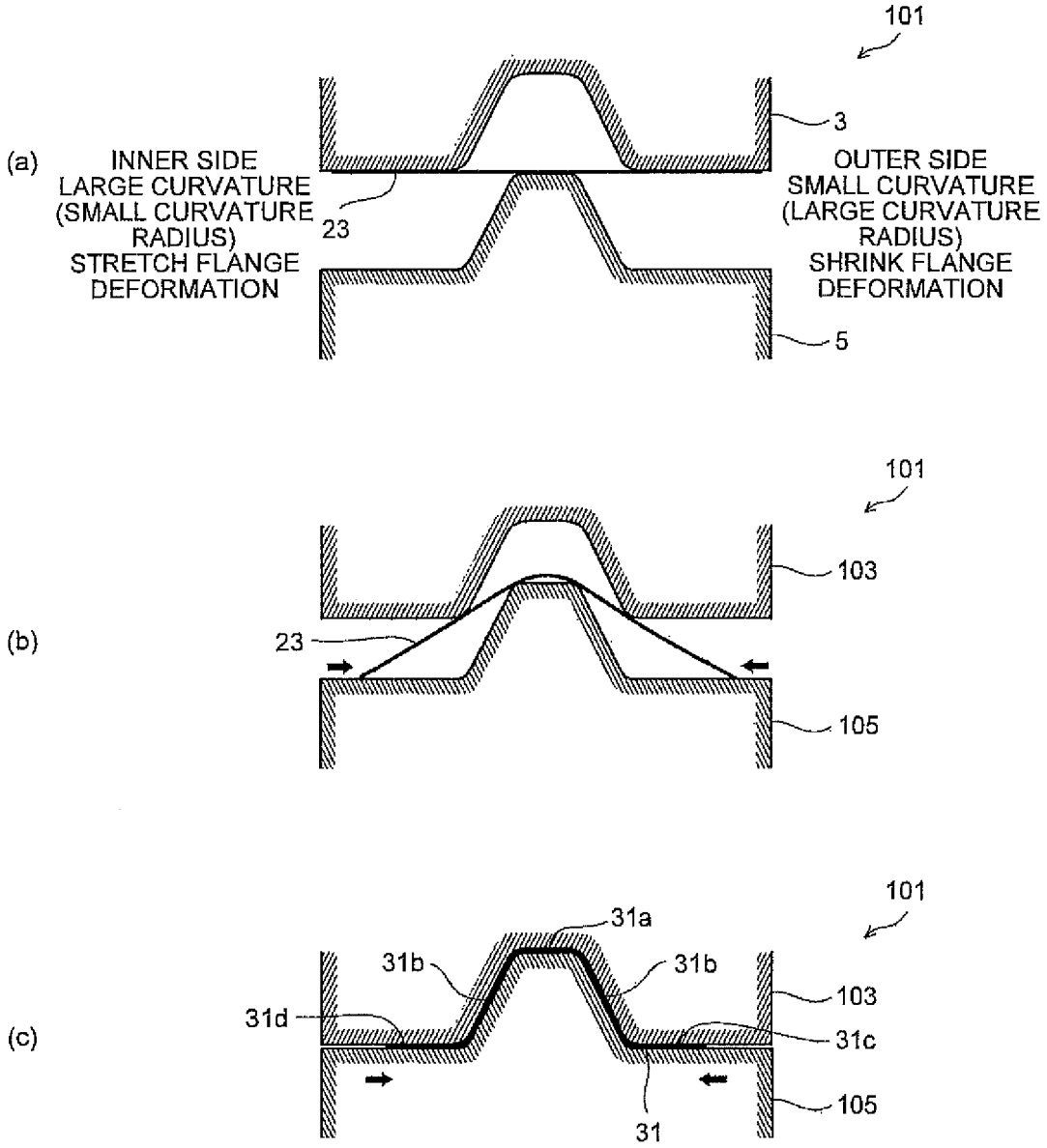
FIG.16 (RELATED ART)
FIGS. 16(*a*), 16(*b*), and 16(*c*) are views for explaining a task of the present invention and are views for explaining the conventional method of press forming.
Figure 17:
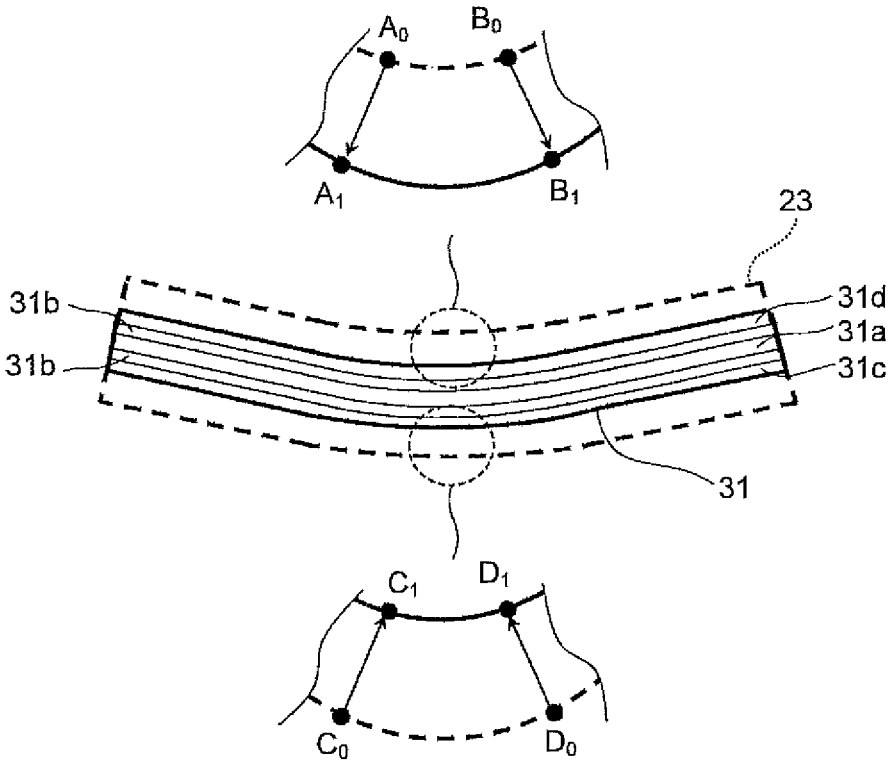
FIG.17 (RELATED ART)
FIG. 17 is an explanatory view of a task of the present invention and is an explanatory view of an occurrence mechanism of springback in the press-formed part formed by the conventional method of press forming.

In the conventional crash forming, a blank 23 is formed by being sandwiched between a die 103 and a punch 105, as illustrated in a perspective view in FIG. 15 and cross-sectional views in FIG. 16. FIG. 17 is a view illustrating visible outlines of the blank before and after forming. The curvature of the visible outline corresponding to a flange (hereinafter, referred to as "inner flange 31*d*") on a large curvature side (small curvature radius side) decreases (a curvature radius becoming large), and a linear length elongates (from a line $A_0B_0$ to a line $A_1B_1$) due to the inflow of blank material when the blank is press-formed. That is, the inner flange 31*d* is in a stretch flange deformation state, and tensile stress remains in the longitudinal direction at a bottom dead center.

By contrast, the curvature of the visible outline corresponding to a flange (hereinafter, referred to as "outer flange 31*c*") on a small curvature side (large curvature radius side) increases (a curvature radius becomes small), and a linear length shortens (from a line $C_0D_0$ to a line $C_1D_1$) due to the inflow of blank material when the blank is press-formed. That is, the outer flange 31*c* is in a shrink flange deformation state, and compressive stress in the longitudinal direction remains in the outer flange 31*c* at the bottom dead center.

Figure 18:
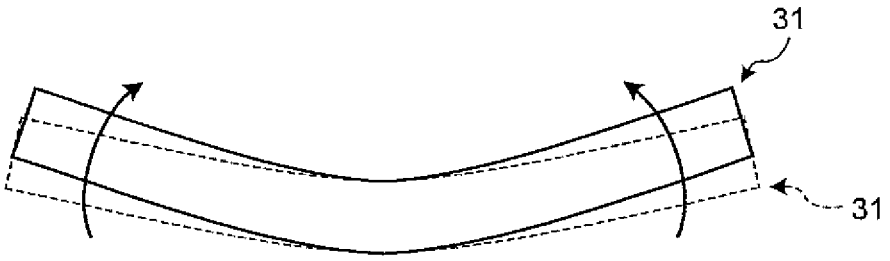
FIG.18 (RELATED ART)
FIG. 18 is an explanatory view of the task of the present invention and is an explanatory view of the springback in the press-formed part formed by the conventional method of press forming.

Such residual stress deforms each flange by elastic recovery at the time of die release and hence, the inner flange 31*d* is in a shrink deformation state and the outer flange 31*c* is in a stretch deformation state. As a result, as illustrated in FIG. 18, the springback that is bending deformation such that the curvature increases (the curvature radius decreases) occurs in the formed part 31. In FIG. 18, broken lines indicate a shape before the springback occurs, and continuous lines indicate a shape after the springback.

In this manner, in a formed part having a flange portion curved in the longitudinal direction, the residual stress in the flange portion is released at the time of die release and hence, the springback that gives bending deformation to the whole formed part occurs. Due to such circumstances, it is reasonable to say that in such a formed part, the reduction of the residual stress in the flange portion is significantly effective for the reduction of the springback of the formed part. Accordingly, the inventors of the present invention have considered a method of reducing residual stress in a flange portion, the method being such that the linear length of the flange portion is largely changed from a product shape in a press-forming process and thereafter, the linear length of the flange portion is restored to the product shape.

Hereinafter, each method of press forming according to embodiments of the present invention devised based on the above-mentioned knowledge is explained.

First Embodiment

Figure 1:
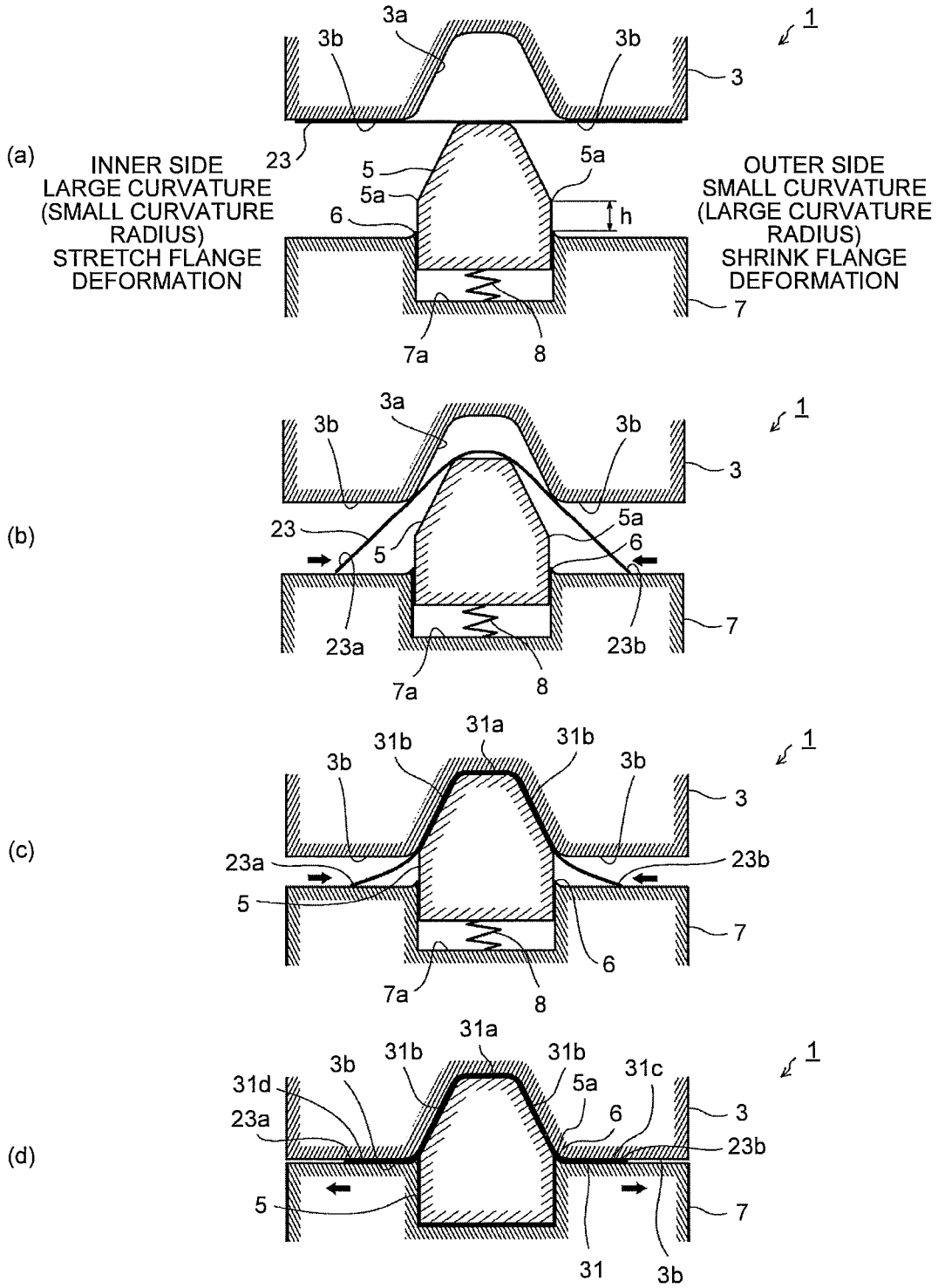
FIGS. 1(*a*), 1(*b*), 1(*c*), and 1(*d*) are views for explaining a method of press forming according to a first embodiment of the present invention.

A method of press forming according to the first embodiment of the present invention; that is, a method of press forming that forms a formed part 31 having a product shape illustrated in FIG. 14, is characterized in that the method includes, as illustrated in FIG. 1, a first forming process that forms a punch bottom portion 31*a* and side wall portions 31*b* into the product shape of the formed part 31 with a die 3 and a punch 5 until reaching a first bottom dead center, and at the same time, forms an outer flange 31*c* and an inner flange 31*d* so that the linear length of the outer flange 31*c* in the longitudinal direction is shorter than the linear length of a flange portion of the formed part 31, and the linear length of the inner flange 31*d* in the longitudinal direction is longer than the linear length of the flange portion of the formed part 31 (see FIG. 1(*a*) to FIG. 1(*c*)); and a second forming process that forms the outer flange 31*c* and the inner flange 31*d* into the product shape of the formed part 31 that were formed in the first forming process, with the die 3 and a flange forming die 7 until reaching a second bottom dead center (see FIG. 1(*d*)), wherein the first forming process and the second forming process are performed by single press forming. Here, the formed part 31 has flanges curved along the longitudinal direction and hence, the curvature of the outer flange 31*c* formed in an arcuate shape decreases, and the curvature of the inner flange 31*d* formed in an arcuate shape increases. Therefore, the outer flange 31*c* corresponds to a flange subject to the shrink flange deformation in the present invention, and the inner flange 31*d* corresponds to a flange subject to the stretch flange deformation in the present invention.

Figure 2:
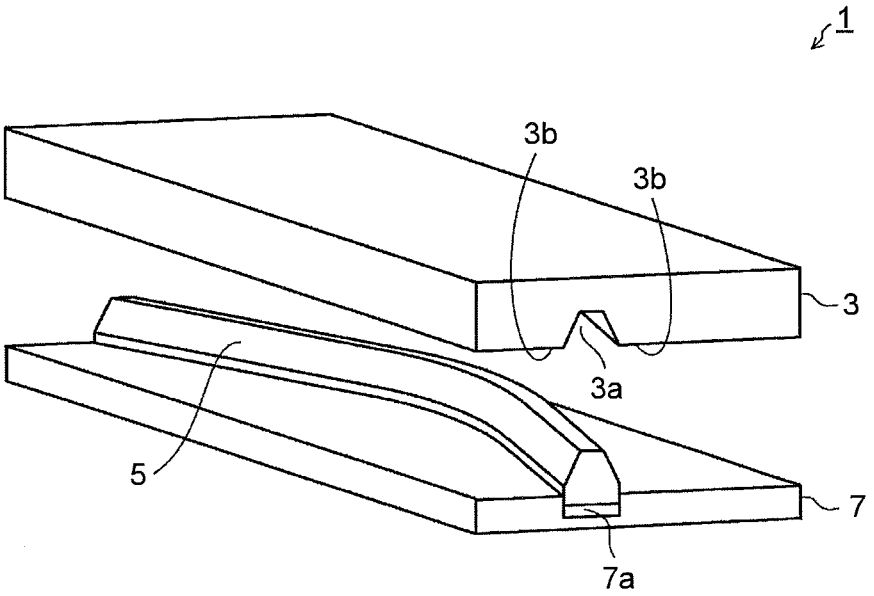
FIG. 2 is a perspective view of an essential part of a press forming apparatus according to the first embodiment of the present invention.
Figure 3:
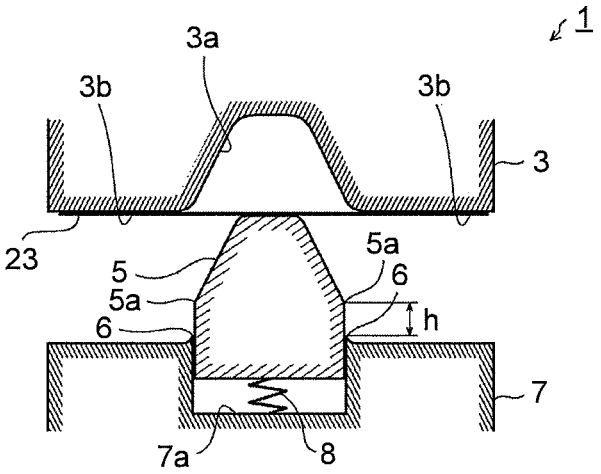
FIG. 3 is a longitudinal sectional view of the essential part of the press forming apparatus according to the first embodiment of the present invention.

In advance of explaining specifically with respect to the above-mentioned method of press forming, a press forming apparatus 1 for performing the above-mentioned method of press forming is briefly explained based on FIG. 1, FIG. 2, and FIG. 3. The press forming apparatus 1 according to the first embodiment of the present invention has the die 3 having a recessed portion 3*a* that curves along the longitudinal direction, the punch 5 an upper part of which is inserted into the recessed portion 3*a* of the die 3 to forms the punch bottom portion 31*a* and the side wall portions 31*b*, and the flange forming die 7 that forms the inner flange 31*d* and the outer flange 31*c* in cooperation with a flange forming portion 3*b* of the die 3. Hereinafter, each component of the press forming apparatus 1 is explained.

Die

The recessed portion 3*a* of the die 3 forms the trench-shaped part 31*e* (see FIG. 14) constituted of the punch bottom portion 31*a* and the side wall portions 31*b* in cooperation with the upper part of the punch 5. The flange forming portion 3*b* of the die 3 forms the inner flange 31*d* and the outer flange 31*c* in cooperation with the flange forming die 7.

Flange Forming Die

The flange forming die 7 has a punch setting groove 7*a* in which the lower part of the punch 5 is set in a vertically movable manner. The punch setting groove 7*a* arranges therein a support mechanism 8 with which the punch 5 is supported in such a manner that the support mechanism 8 is shrinkable by being depressed with the punch 5. Here, the support mechanism 8 is set in such a manner that the support mechanism 8 is unshrinkable by a depressing pressure applied to the punch 5 in press-forming the punch bottom portion 31*a* and the side wall portions 31*b* with the die 3 and the punch 5 (the first forming process). As the support mechanism 8, an elastic body such as a spring or rubber, a fluid pressure cylinder, or other devices is applicable.

Punch

The Punch 5 is formed in a convex shape. As described above, the lower part of the punch 5 is arranged in the punch setting groove 7*a* of the flange forming die 7 in a vertically movable manner. When the bottom surface of the punch 5 abuts on punch setting groove 7*a*, as illustrated in FIG. 1(*d*), a side-wall-portion forming surface lowermost end 5*a* of the punch 5 is continuously connected to a groove wall upper end 6 of the punch setting groove 7*a* in the flange forming die 7. At the time of starting press-forming, the punch 5 is supported with the support mechanism 8 so that the side-wall-portion forming surface lowermost end 5*a* of the punch 5 is positioned at a predetermined height from the groove wall upper end 6 of the punch setting groove 7*a* in the flange forming die 7, and the height corresponds to a relative moving distance h of the punch 5. The relative moving distance h is easily changeable by changing the length of the support mechanism 8.

The explanation is specifically made with respect to the method of press forming, which uses the press forming apparatus 1 constituted as mentioned above, according to the first embodiment of the present invention. The technical feature of the present invention lies in that in press-forming, the linear lengths of the inner flange 31*d* and the outer flange 31*c* in the longitudinal direction are slightly changed thus reducing the springback. Focusing on such a point, the method of press forming is specifically explained based on FIG. 1 and FIG. 4.

Figure 4:
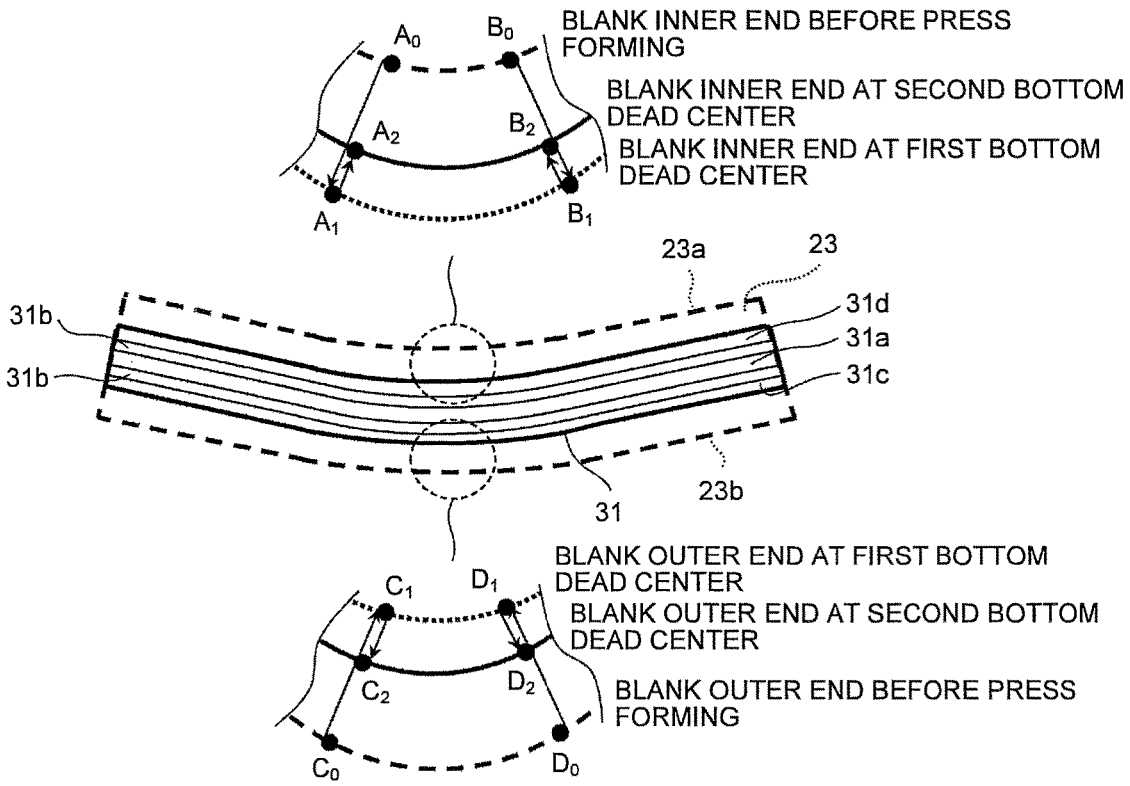
FIG. 4 is an explanatory view of a mechanism exerting an effect of the method of press forming according to the first embodiment of the present invention.

FIG. 4 is an explanatory view for explaining the change in visual outline length in each of the inner flange 31*d* and the outer flange 31*c* in a period from the time before the press forming is started to the time reaching the first bottom dead center, and further to the time reaching the second bottom dead center. FIG. 4 illustrates each portion surrounded by a dashed circle in an enlarged manner with respect to the inside and the outside of a curved portion. In each enlarged view, dashed lines illustrate an inner end 23*a* and an outer end 23*b* of a blank 23 before press-forming, dotted lines illustrate the inner end 23*a* and the outer end 23*b* at a time when the die 3 is positioned at the first bottom dead center, and continuous lines illustrate the inner end 23*a* and the outer end 23*b* at a time when the die 3 is positioned at the second bottom dead center, respectively. As illustrated in FIG. 4, for example, a point $A_0$ and a point $B_0$ before starting the press forming move to a point $A_1$ and a point $B_1$ when the die 3 is positioned at the first bottom dead center, respectively, and move to a point $A_2$ and a point $B_2$ when the die 3 is positioned at the second bottom dead center, respectively. Accordingly, a visible outline $A_0B_0$ changes into a visible outline $A_1B_1$, and further changes into a visible outline $A_2B_2$.

The blank 23 is, as illustrated in FIG. 1(*a*), placed on the upper surface of the punch 5. The punch 5 is supported with the support mechanism 8 so that the height of the side-wall-portion forming surface lowermost end 5*a* from the flange forming die 7 is set to h.

First Forming Process

First, the die 3 is moved (see FIG. 1(*b*)), and the punch bottom portion 31*a* and the side wall portions 31*b* are formed into a product shape (the first bottom dead center, see FIG. 1(*c*)) (first forming process). As mentioned above, the punch 5 is supported with the support mechanism 8 during this process so as not to be moved. When the side wall portions 31*b* are formed, the inflow of the blank 23 causes the inner end 23*a* and the outer end 23*b* of the blank 23 to move to a side of the punch 5, as indicated by bold arrows in FIG. 1(*b*) and FIG. 1(*c*).

As viewed in the enlarged view of the inner side of the curved portion in FIG. 4, in a period from the time of starting the press forming to the time reaching the first bottom dead center (first forming process), a visible outline $A_0B_0$ of the inner end 23*a* changes into a visible outline $A_1B_1$ by the inflow of the blank, 23; that is, the linear length of the inner end 23*a* is elongated (stretch flange deformation). By contrast, in the outer side of the curved portion, a visible outline $C_0D_0$ in the outer end 23*b* is, as illustrated in the enlarged view in FIG. 4, changed into the visible outline $C_1D_1$ by the inflow of the blank 23; that is, the linear length of outer end 23*b* is reduced (shrink flange deformation).

Second Forming Process

Next, a depression pressure of the die 3 is more increased than a support force of the punch 5 supported with the support mechanism 8 to integrally move the die 3 and the punch 5 while the die 3 and the punch 5 hold the punch bottom portion 31*a* and the side wall portions 31*b*. Due to such an operation, the inner flange 31*d* and the outer flange 31*c* are formed into a product shape with the flange forming portion 3*b* of the die 3 and the flange forming die 7 (second bottom dead center, see FIG. 1(*d*)) (second forming process). In this time, the inner end 23*a* and the outer end 23*b* of the blank 23 outwardly move as indicated by bold arrows in FIG. 1(*d*).

As viewed in the enlarged view of the inner side of the curved portion in FIG. 4, the inner end 23*a* is outwardly extruded (outflow) and deformed at the second bottom dead center and hence, the linear length of the inner end 23*a* is slightly reduced ($A_1B_1$ to $A_2B_2$), and changed into a linear length of the inner flange 31*d* in the product shape of the formed part 31. By contrast, in the inner side of the curved portion, the linear length of the outer end 23*b* is slightly increased ($C_1D_1$ to $C_2D_2$).

Figure 5:
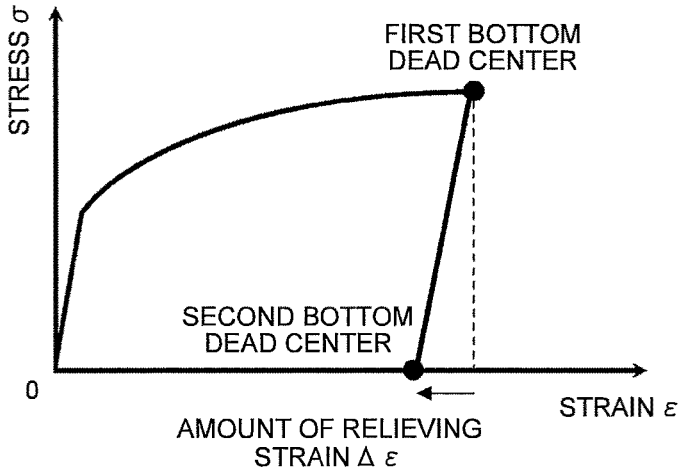
FIG. 5 is an explanatory view of a mechanism exerting the effect of the method of press forming according to the first embodiment of the present invention.

In this manner, the inner flange 31*d* is, in the first forming process, once formed so that the linear length thereof is more increased than that of the product shape of the formed part 31, and formed, in the second forming process, so that the linear length thereof is restored to that of the product shape of the formed part 31. By contrast, the outer flange 31*c* is, in the first forming process, once formed so that the linear length thereof is more decreased than that of the product shape of the formed part 31, and formed, in the second forming process, so that the linear length thereof is restored to that of the product shape of the formed part 31. Accordingly, in the inner flange 31*d* and the outer flange 31*c*, strain generated in the first forming process is slightly relieved in the second forming process thus considerably reducing residual stress. In this respect, the explanation is made based on FIG. 5. FIG. 5 is a stress-strain diagram illustrating the relation between stress and strain in the longitudinal direction in a period from the time of starting press-forming the flange portion to the time reaching the second bottom dead center. As illustrated in FIG. 5, large residual stress is accumulated in the flange portion at the first bottom dead center in the first forming process. However, the strain is slightly relieved from the first bottom dead center to the second bottom dead center thus considerably reducing the residual stress. In this manner, the present invention is made by utilizing a technical feature such that the residual stress changes largely and sensitively when the strain is slightly relieved.

The amount of relieving the strain is determined by a relative moving distance h of the punch 5 and a flange width. When the flange width is constant, the larger the relative moving distance h is, the larger the amount of relieving the strain becomes, thus developing the large reduction effect of the residual stress. That is, in the present invention, the relative moving distance h of the punch 5 to the flange forming die 7 has large influence on a springback quantity, and the relative moving distance h is adjusted thus controlling the springback at the site of press forming. In this manner, the present invention is capable of reducing the springback at lower cost for a short period of time compared with a conventional method that reduces the springback by correcting a tool of press forming while repeating trial and error. When the amount of relieving the strain is excessively large, oppositely directed residual stress is accumulated and hence, it is necessary to appropriately set the amount of relieving the strain.

Here, the flange width of the formed part 31 is indicated as L (see FIG. 14). It is desirable to set the ratio of the flange width L and the relative moving distance h (h/L) within the range such that $0.05<h/L<1.0$. This point is verified in Examples described later.

As mentioned above, in the present embodiment, the material of the flange portion that once entered into the inside of the formed part in a forming process is pressed back to the outside of the formed part, and the strain in the longitudinal direction is slightly relieved thus reducing the residual stress. Accordingly, it is possible to reduce the springback without changing a product shape and without generating forming defects, such as fractures or wrinkles.

Second Embodiment

Figure 6:
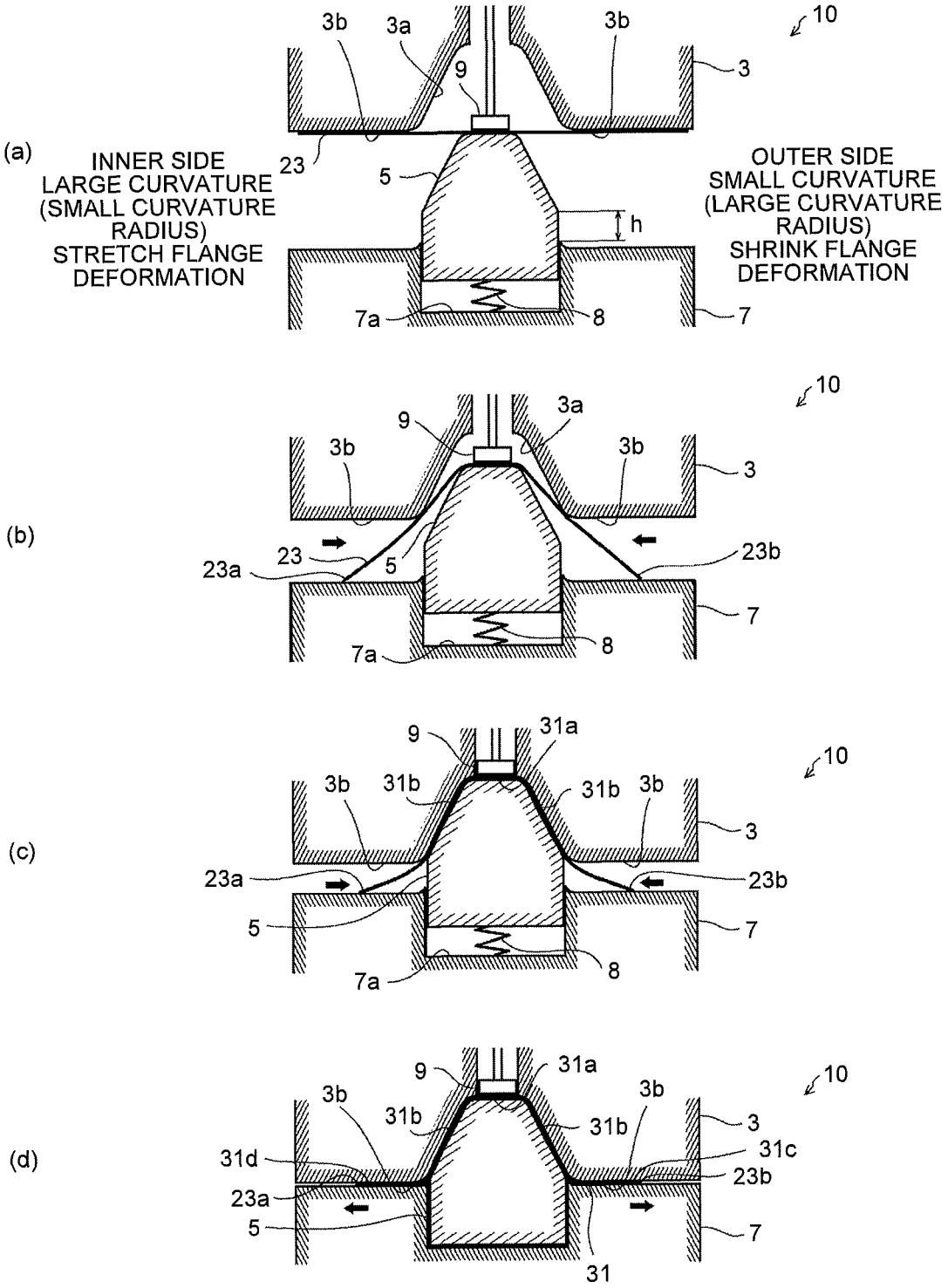
FIGS. 6(*a*), 6(*b*), 6(*c*), and 6(*d*) are views for explaining a method of press forming according to a second embodiment of the present invention.

The first embodiment is explained by taking the press forming apparatus 1 having the die 3, the punch 5, and the flange forming die 7 as an example. However, as a press forming apparatus 10 illustrated in FIG. 6, a pad 9 that sandwiches a part corresponding to the punch bottom portion 31*a* of the blank 23 in cooperation with the punch 5 may be provided to sandwich the blank 23 by the pad 9 and the punch 5 from the time of starting the first forming process. Due to such a constitution, it is possible to surely prevent the blank 23 from being misaligned in the first forming process. Here, in the press forming apparatus 10 in FIG. 6, parts identical with those in the press forming apparatus 1 in FIG. 1 are given same numerals.

Third Embodiment

Figure 7:
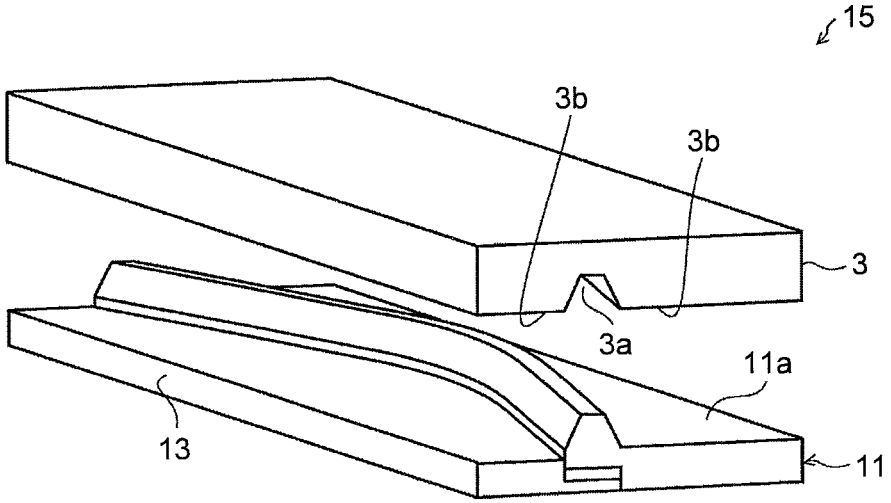
FIG. 7 is an explanatory view of an essential part of a press forming apparatus according to a third embodiment of the present invention.

In the first and the second embodiments, the explanation has been made with respect to the example in which the strain is relieved in both the inner flange 31*d* and the outer flange 31*c*. However, residual stresses in the inner flange 31*d* and the outer flange 31*c* may be balanced for reducing the springback in the formed part 31 as a whole, and press forming may also be performed in such a manner that the strain is relieved in either one of the inner flange 31*d* and the outer flange 31*c*. For example, when the strain is relieved only in the inner flange 31*d*, as illustrated in FIG. 7, the press forming is performed by using a press forming apparatus 15 that includes a punch 11 having an outer flange forming portion 11*a*, and an inner flange forming die 13.

The punch 11 forms the punch bottom portion 31*a*, the side wall portions 31*b*, and the outer flange 31*c* in cooperation with the die 3. The other constitution of the press forming apparatus 15 is identical with that of the press forming apparatus 1, and in FIG. 7, parts identical with those in the press forming apparatus 1 are given same numerals.

Figure 8:
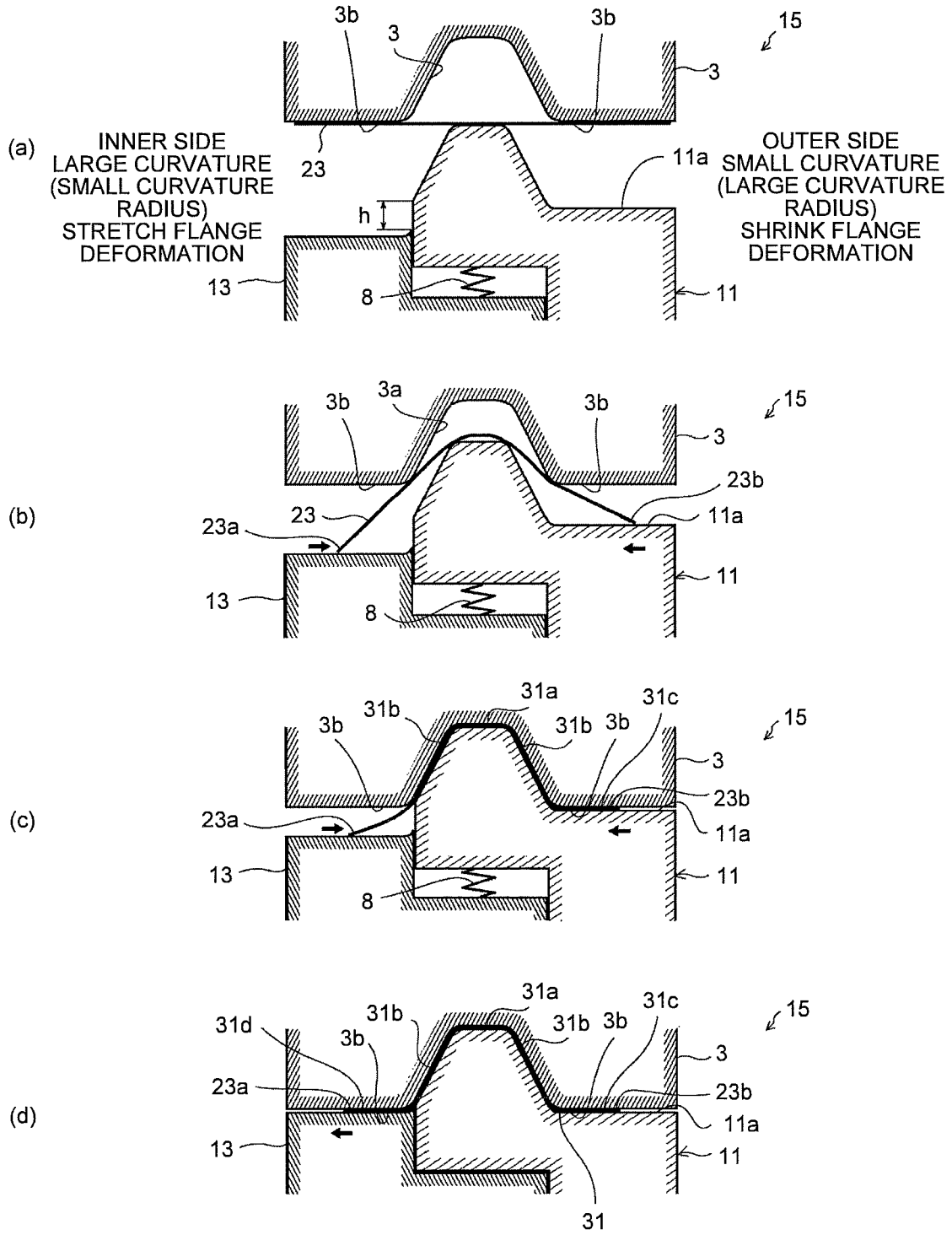
FIGS. 8(*a*), 8(*b*), 8(*c*), and 8(*d*) are views for explaining a method of press forming when the press forming apparatus in FIG. 7 is used.

A method of press forming that uses the press forming apparatus 15 is explained based on FIG. 8. First, the blank 23 is placed as illustrated in FIG. 8(*a*), and the die 3 is moved (see FIG. 8(*b*)). When the die 3 is positioned at the first bottom dead center (see FIG. 8(*c*)), the inner end 23*a* is in a stretch flange deforming state, and the outer end 23*b* is in a shrink flange deforming state. Furthermore, when the die 3 is positioned at the second bottom dead center (see FIG. 8(*d*)), the linear length of the inner end 23*a* in the longitudinal direction is slightly reduced, and the stretch flange deforming is relieved thus considerably decreasing the tensile stress. In this manner, the inner flange 31*d* and the outer flange 31*c* are balanced in residual stress thus relieving the deformation attributed to the springback in the formed part 31 as a whole.

Fourth Embodiment

Figure 9:
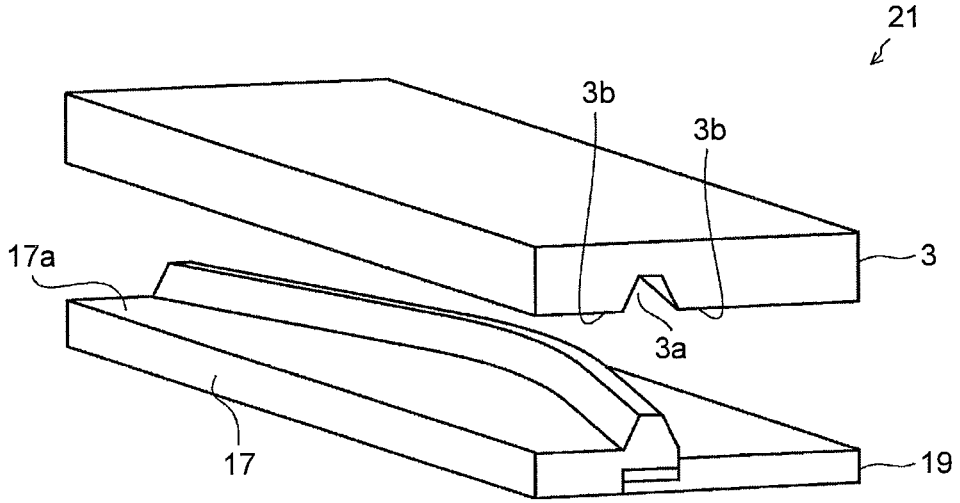
FIG. 9 is an explanatory view of an essential part of a press forming apparatus according to a fourth embodiment of the present invention.

In contrast with the case described in the third embodiment, the strain may be relieved only in the outer flange 31*c*. In this case, as illustrated in FIG. 9, a press forming apparatus 21 that includes a punch 17 having an inner flange forming portion 17*a*, and an outer flange forming die 19 is used. The punch 17 forms the punch bottom portion 31*a*, the side wall portions 31*b*, and the inner flange 31*d* in cooperation with the die 3. The other constitution of the press forming apparatus 21 is identical with that of the press forming apparatus 1, and in FIG. 9, parts identical with those in the press forming apparatus 1 are given same numerals.

In this case, when the die 3 is positioned at the first bottom dead center, the inner flange 31*d* is in the stretch flange deformation state, and the outer flange 31*c* is in the shrink flange deforming state in the same manner as the case of the third embodiment mentioned above. When the forming advances thereafter and the die 3 is positioned at the second bottom dead center, a linear length of the outer flange 31*c* is slightly increased, the shrink flange deformation is relieved, and the compressive stress is considerably decreased. In this manner, the inner flange 31*d* and the outer flange 31*c* are balanced in residual stress thus relieving the deformation attributed to the springback in the formed part 31 as a whole.

In the second forming process mentioned above, the explanation has been made with respect to the case in which the die 3 and the punch 5 are brought close to the flange forming die 7 as one example of a method of forming the inner flange 31*d* and the outer flange 31*c*. However, it may be possible to adopt the constitution in which the die 3 and the punch 5 are stopped at the first bottom dead center, and the flange forming die 7 is brought close to the side of the die 3.

Figure 10:
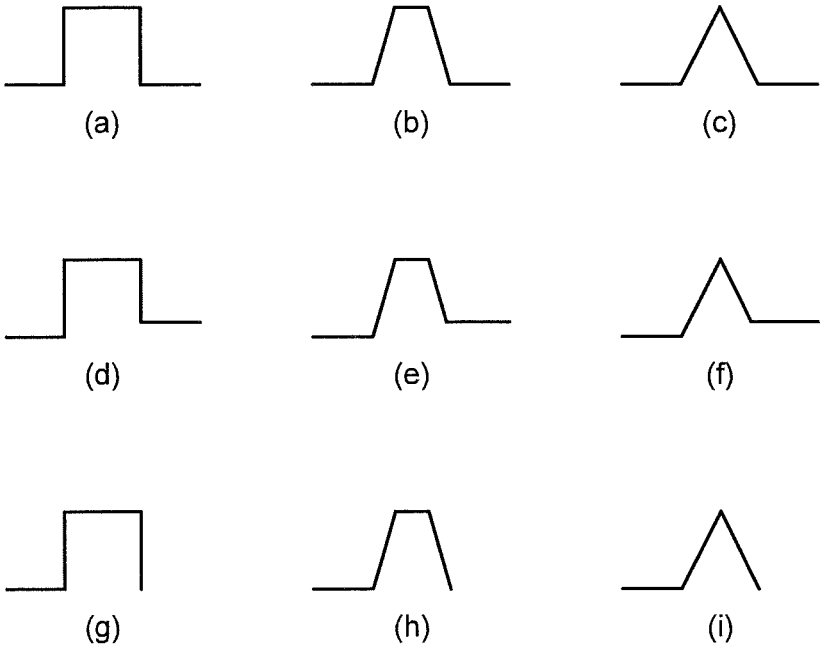
FIGS. 10(*a*), 10(*b*), 10(*c*), 10(*d*), 10(*e*), 10(*f*), 10(*g*), 10(*h*), and 10(*i*) are views each explaining a mode of a shape of a press-formed part to which the present invention is applicable.

Furthermore, it may be possible to adopt, as a product shape of a formed part in which advantageous effects of the present invention is developed, a shape having a flange that curves along the longitudinal direction and a flange formed in at least one of a pair of side walls that constitutes a trench-shaped part. FIG. 10 illustrates a plurality of cross-section examples of product shapes of formed parts to which the present invention is applicable, and each cross section is explained below. FIG. 10(*a*) to FIG. 10(*f*) illustrate cross sections of the product shapes of the formed parts each having respective curved flanges arranged on both the inside and the outside of the formed part. FIGS. 10(*a*) and 10(*d*) illustrate the cross sections of the product shapes of the formed parts each of which has side walls raised perpendicularly. FIGS. 10(*b*) and 10(*e*) illustrate the cross sections of the product shapes of the formed parts each of which has side walls inclining, each of the cross sections being identical with the cross section of the product shape of the formed part 31 mentioned above. FIGS. 10(*c*) and 10(*f*) illustrate the cross sections of the product shapes of the formed parts each of which has side walls inclining and formed in a triangle shape. In order to form the cross sections in FIGS. 10(*c*) and 10(*f*), it is desirable to use a punch a distal end of which is formed in a rounded shape. Furthermore, as illustrated in FIG. 10(*g*) to FIG. 10(*i*), the formed part may have a curved flange formed in either one of the inside and the outside of each formed part in FIG. 10(*a*) to FIG. 10(*c*). There is no restriction with respect to a length, a height position, and an angle of the flange. As a formed part 41 illustrated in FIG. 19(*a*) and a formed part 43 illustrated in FIG. 19(*b*), the formed part may have a curving flange formed in either one of the inner side and the outer side thereof and an uncurving flange formed in the other side thereof, or the formed part may have an uncurving product shape as a whole.

Figure 19:
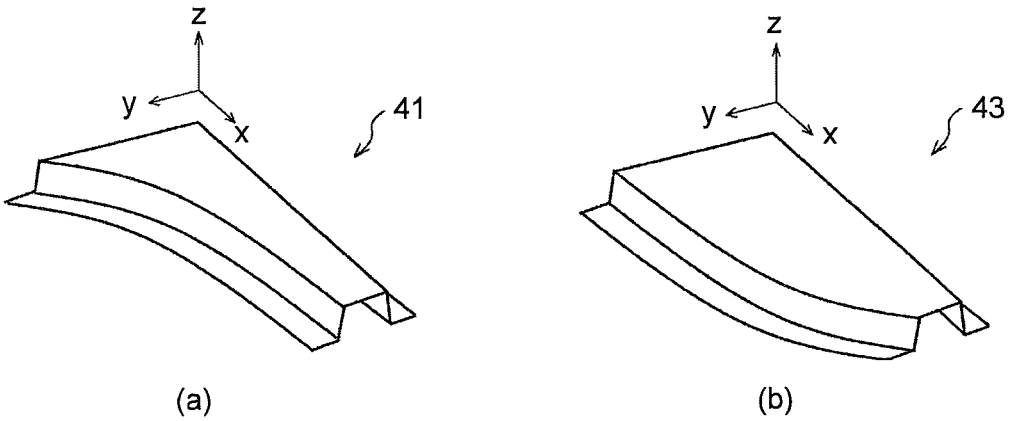
FIGS. 19(*a*) and 19(*b*) are views each illustrating one example of a product shape to which the present invention is applicable.
Figure 20:
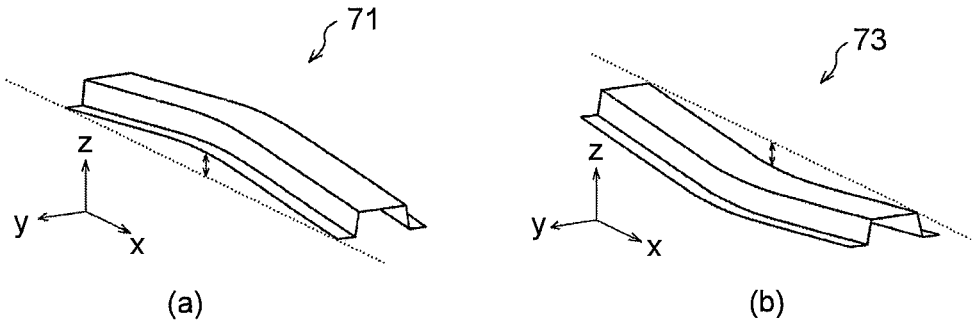
FIGS. 20(*a*) and 20(*b*) are views each illustrating one example of a product shape to which the present invention is applicable.
Figure 21:
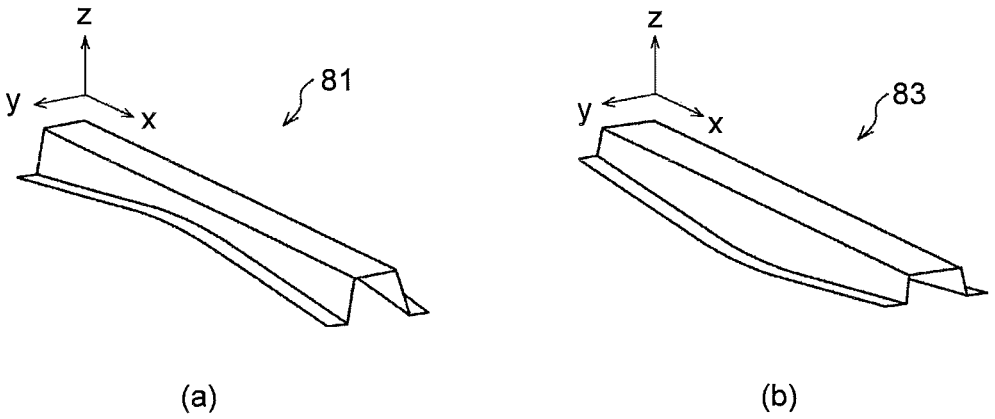
FIGS. 21(*a*) and 21(*b*) are views each illustrating one example of a product shape to which the present invention is applicable.

Furthermore, when the longitudinal direction, the width direction, and the height direction of the formed part are indicated as an x direction, a y direction, and a z direction, respectively (see FIG. 19), the formed part curves in an x-y plane in the explanation made in the above-mentioned first to fourth embodiments, and in conjunction with FIG. 19. However, the formed part to which the present invention is applicable is not limited to such a curving formed part and, as illustrated in FIG. 20 and FIG. 21, also includes a formed part flanges of which curve in the z direction. FIG. 20(*a*) illustrates one example of a shape formed in an upward convex shape curving around the center portion thereof in the longitudinal direction (formed part 71), and FIG. 20(*b*) illustrates one example of a shape formed in a downward convex shape curving around the center portion thereof in the longitudinal direction (formed part 73). Furthermore, FIG. 21(*a*) illustrates one example of a shape formed in such a manner that only flanges of a formed part are formed in an upward convex shape curving around the center portion thereof in the longitudinal direction (formed part 81), and FIG. 21(*b*) illustrates one example of a shape formed in such a manner that only flanges of a formed part are formed in a downward convex shape curving around the center portion thereof in the longitudinal direction (formed part 83).

EXAMPLE 1

Figure 11:
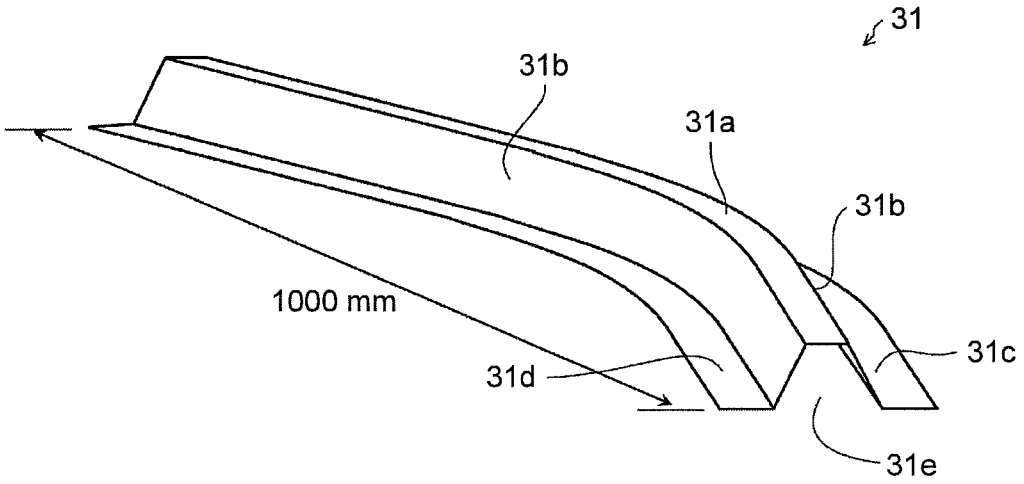
FIG. 11 is an explanatory view of a product shape of a press-formed part according to Example 1 of the present invention.
Figure 12:
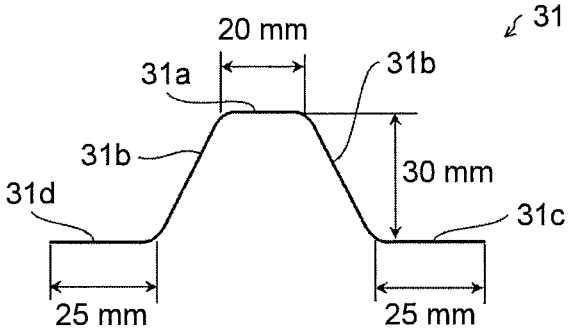
FIG. 12 is an explanatory view of the product shape of the press-formed part according to Example 1 of the present invention.
Figure 13:
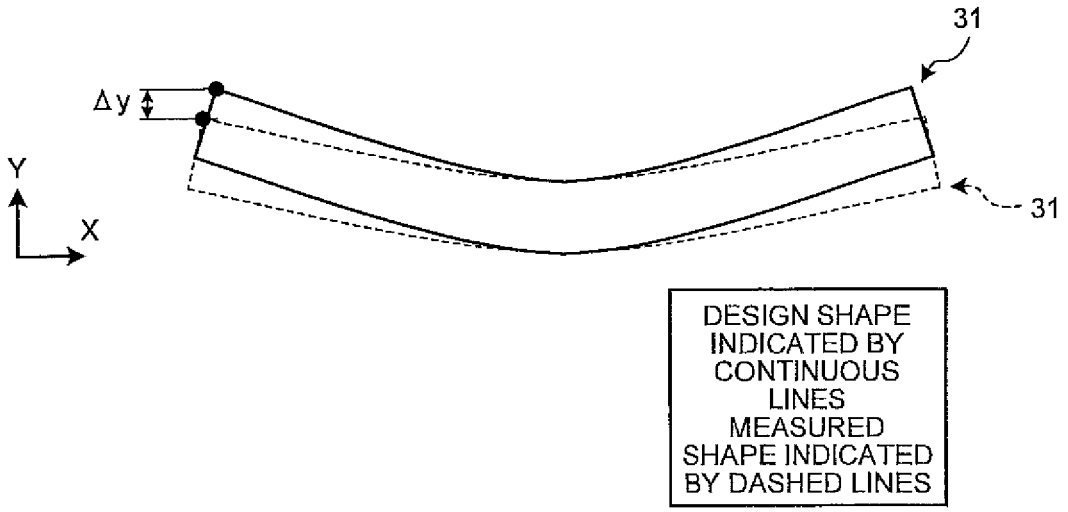
FIG. 13 is an explanatory view of a method of evaluation of a springback quantity according to Example 1 of the present invention.

Specific experiments with respect to the manner of operation and advantageous effects with the method of press forming of the present invention were conducted. The results of the experiments are explained below based on FIG. 11 to FIG. 13 with reference to the other drawings as needed. First, the method of the experiments is outlined. The experiments were such that formed parts were formed by using the press forming apparatus 1 under a plurality of press-forming conditions, and the springback quantities of the formed parts formed were compared with each other. The formed part 31 is, as illustrated in FIG. 11 and FIG. 12, to be formed in a shape that has a hat-shaped section and curves along the longitudinal direction, the shape being 1000 mm in length, 30 mm in height of the section, 20 mm in width of the punch bottom portion 31*a*, 25 mm in width of both the inner flange 31*d* and the outer flange 31*c*, and 1000 mm in radius of curvature in the longitudinal direction at the center of the width of the formed part 31. A 980 MPa grade steel sheet being 1.2 mm in thickness was used for the blank 23. A 1000 tonf hydraulic press was used as a pressing machine.

Hereinafter, press-forming conditions are explained in detail. In a present-invention example 1 to a present-invention example 7, in order to confirm the influence of the relative moving distance h of the punch 5, the relative moving distance h was set to each of seven levels of 2.5, 5, 10, 15, 20, 25 and 30 mm. In the present-invention example 1 to the present-invention example 7, the second forming process was performed in such a manner that the flange forming die 7 was fixed, and the die 3 and the punch 5 were downwardly moved while holding the punch bottom portion 31*a* and the side wall portions 31*b* at the bottom dead center. Furthermore, a present-invention example 8 adopted a method of press forming such that the flange forming die 7 is upwardly moved in a state that the die 3 and the punch 5 is stopped while holding the punch bottom portion 31*a* and the side wall portions 31*b* at the bottom dead center. In the present-invention example 1 to the present-invention example 8, the press forming apparatus 1 illustrated in FIG. 1 to FIG. 3 was used.

In a comparative example 1, a press forming apparatus 101 (see FIG. 15) was used to perform conventional crash forming (see FIG. 16) by using the general punch 105 (relative moving distance h=0 mm) that forms the punch bottom portion 31*a*, the side wall portions 31*b*, and the flange portion (inner flange 31*d* and outer flange 31*c*). In order to confirm the effect when a top plate portion is pressed with the use of a pad 9, crash forming (relative moving distance h=10 mm), with the use of a pad, according to the present invention that uses the press forming apparatus 10 illustrated in FIG. 6 was performed as a present-invention example 9, and crash forming using the general punch 105 (relative moving distance h=0 mm) and a die with a pad was performed as a comparative example 2. The pad pressure was set to 50 tonf.

The product shape of the formed part formed was measured by a three-dimensional shape measurement. Thereafter, the alignment of measurement data was performed on computer-aided design (CAD) software so that the curving portion at the center of the formed part in the longitudinal direction coincides with a design shape, the difference in y coordinate (bending amount Δy, see FIG. 13) between measurement shape data and design shape data at the end of the formed part was calculated, and the bending amount Δy was set to the index of the bending deformation due to the springback. The condition that the bending amount Δy is positive implied that the formed part is deformed to be bent in the direction in which the curvature becomes large (the curvature radius becomes small). The condition that the bending amount Δy is negative implies that the formed part is deformed to be bent in the direction in which the curvature becomes small (the curvature radius becomes large). Furthermore, the condition that the absolute value of the bending amount Δy is small implies that the springback quantity is small. Table 1 indicates press-forming conditions (relative moving distance h (mm), h/L, presence or absence of the pad, and the method of flange forming (downward moving of the die 3 and the punch 5 or upward moving of the flange forming die 7)) and the bending amount Δy (mm) of the formed part 31 formed under each press-forming condition.

TABLE 1

| | Press forming condition | | | | | |
|---|---|---|---|---|---|---|
| | | | | Method of forming flange portion | | |
| | Relative moving distance h (mm) | h/L | Presence or absence of pad | Downward movement of die and punch | Upward movement of flange forming die | Bending amount Δy (mm) |
| Comparative example 1 | 0 | 0.0 | Absence | — | — | 7.3 |
| Present-invention example 1 | 2.5 | 0.1 | Absence | ○ | — | 6.7 |
| Present-invention example 2 | 5 | 0.2 | Absence | ○ | — | 5.5 |
| Present-invention example 3 | 10 | 0.4 | Absence | ○ | — | 1.2 |
| Present-invention example 4 | 15 | 0.6 | Absence | ○ | — | −1.9 |
| Present-invention example 5 | 20 | 0.8 | Absence | ○ | — | −3.3 |
| Present-invention example 6 | 25 | 1.0 | Absence | ○ | — | −5.1 |
| Present-invention example 7 | 30 | 1.2 | Absence | ○ | — | −5.1 |
| Present-invention example 8 | 10 | 0.4 | Absence | — | ○ | 1.2 |
| Comparative example 2 | 0 | 0.0 | Presence | — | — | 9.6 |
| Present-invention example 9 | 10 | 0.4 | Presence | ○ | — | 1.3 |

As can be understood from the present-invention example 1 to the present-invention example 7 in Table 1, when the relative moving distance h increases, the bending amount Δy becomes smaller than that in the case of the comparative example 1. Furthermore, the positive and the negative of the bending amount Δy were reversed when h=15 mm. The forming condition in which the bending amount Δy is smallest is indicated in the present-invention example 3 (h=10 mm without pad); that is, the bending amount Δy=1.2 mm. The springback was considerably decreased compared with the case of the conventional crash forming in the comparative example 1.

As illustrated in the present-invention example 8, even when the flange forming die 7 was upwardly moved, the considerable improvement of the springback was confirmed in the same manner as the case where the punch 5 was downwardly moved (see the present-invention example 3). Furthermore, as can be understood from the comparative example 2 and the present-invention example 9, even when the pad 9 was used, the springback was decreased.

EXAMPLE 2

In the above-mentioned Example 1, forming in which strain is relieved was applied to both the inner flange 31*d* and the outer flange 31*c*. In Example 2, the specific experiments were conducted with respect to the effect when the forming in which strain is relieved was applied to either one of the inner flange 31*d* and the outer flange. The results of the experiments are explained below.

First, the methods of the experiments are outlined. The forming in which strain is relieved was applied only to the inner flange 31*d* in a present-invention example 10 to a present-invention example 14, and applied only to the outer flange 31*c* in a present-invention example 15 to a present-invention example 19. In the present-invention example 10 to the present-invention example 14, the press forming apparatus 15 illustrated in FIG. 7 and FIG. 8 was used, and in the present-invention example 15 to the present-invention example 19, the press forming apparatus 21 illustrated in FIG. 9 was used. The respective relative moving distances h in the present-invention example 10 to the present-invention example 14 were set to 5, 10, 15, 20, and 25 mm, and in the same manner as above, the respective relative moving distances h in the present-invention example 15 to the present-invention example 19 were set to 5, 10, 15, 20, and 25 mm. Furthermore, as a comparative example 3, the conventional crash forming (see FIG. 16) that uses the press forming apparatus 101 (general punch 105 (relative moving distance h=0 mm)) (see FIG. 15) was performed. A part to be formed, a hydraulic press machine, and a method of evaluating the springback are similar to those described in Example 1.

Table 2 indicates each press-forming condition (applied flange, relative moving distance h (mm), h/L) and the bending amount Δy (mm) of the formed part 31 formed under the press-forming condition.

TABLE 2

| | Press forming condition | | | |
|---|---|---|---|---|
| | Applied flange | Relative moving distance h (mm) | h/L | Bending amount Δy (mm) |
| Comparative example 3 | — | 0 | 0.0 | 7.3 |
| Present-invention example 10 | Inner | 5 | 0.2 | 6.8 |
| Present-invention example 11 | Inner | 10 | 0.4 | 3.0 |
| Present-invention example 12 | Inner | 15 | 0.6 | 0.5 |
| Present-invention example 13 | Inner | 20 | 0.8 | −2.3 |
| Present-invention example 14 | Inner | 25 | 1.0 | −4.2 |

TABLE 2-continued

| | Press forming condition | | | |
|---|---|---|---|---|
| | Applied flange | Relative moving distance h (mm) | h/L | Bending amount Δy (mm) |
| Present-invention example 15 | Outer | 5 | 0.2 | 7.0 |
| Present-invention example 16 | Outer | 10 | 0.4 | 3.9 |
| Present-invention example 17 | Outer | 15 | 0.6 | 1.1 |
| Present-invention example 18 | Outer | 20 | 0.8 | −1.7 |
| Present-invention example 19 | Outer | 25 | 1.0 | −3.6 |

The forming condition that minimizes the springback quantity (minimizes the absolute value of the bending amount Δy) is indicated in the present-invention example 12 (h=15 mm) out of the examples that the forming in which strain is relieved was applied to the inner flange 31*d*; that is, Δy=0.5 mm, and indicated in the present-invention example 17 (h=15 mm) out of the examples that the forming in which strain is relieved was applied to the outer flange 31*c*; that is, Δy=1.1 mm and hence, the springback was considerably decreased compared with the case of the comparative example 3; that is, Δy=7.3 mm. As mentioned above, even when the present invention that relieves strain is applied to either one of the inner flange 31*d* and the outer flange 31*c*, a high springback suppression effect was confirmed.

EXAMPLE 3

In the above-mentioned Example 1 and Example 2, the experiments with respect to the products each curved in the x-y plane were conducted. In the present example, experiments with respect to products each curved in the z direction (pressing direction) were performed. The results of the experiments are explained. First, the methods of the experiments are outlined.

Figure 22:
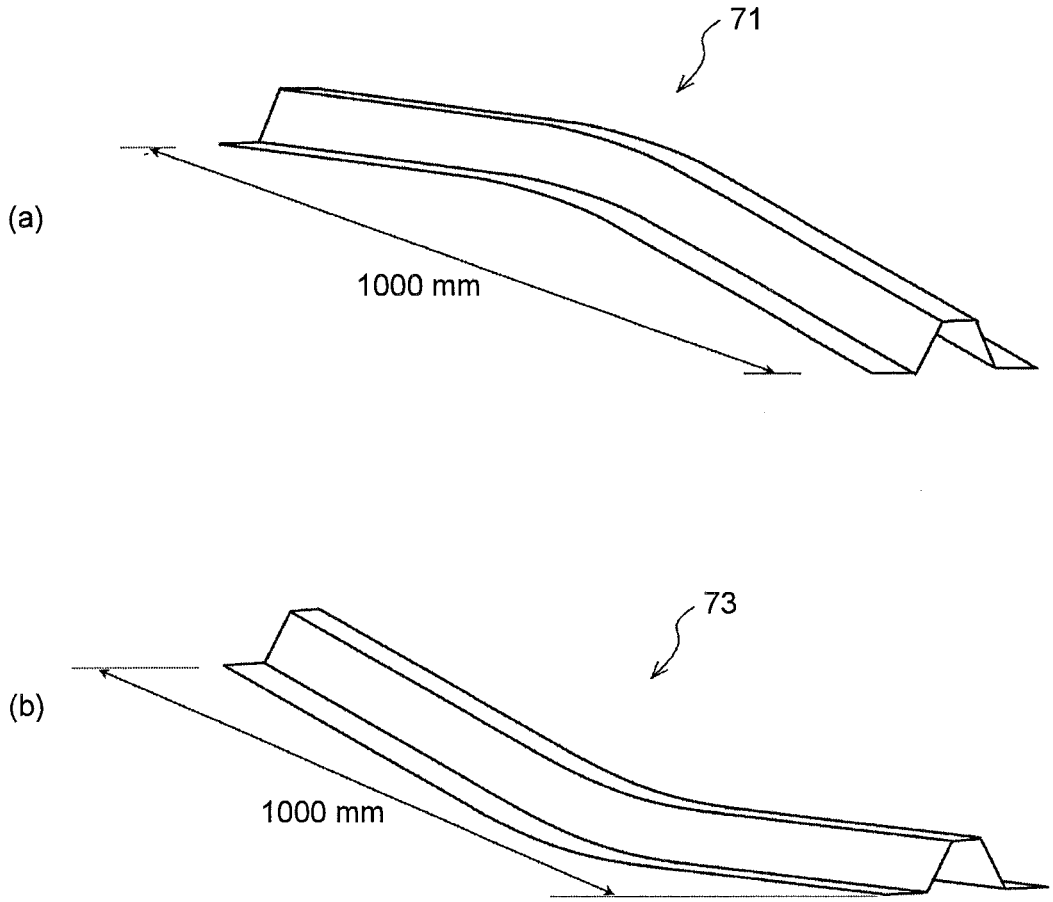
FIGS. 22(*a*) and 22(*b*) are explanatory views of respective product shapes of press-formed parts according to Example 3 of the present invention.

In a present-invention example 20 to a present-invention example 24, the present invention is applied to the press-formed part 71 that is, as illustrated in FIG. 22(*a*), formed in an upward convex shape curving around the center portion thereof in the longitudinal direction as a whole, and in a present-invention example 25 to a present-invention example 29, the present invention is applied to the formed part 73 that is, as illustrated in FIG. 22(*b*), formed in a downward convex shape curving around the center portion thereof in the longitudinal direction as a whole. Each of the formed part 71 and the formed part 73 is 1000 mm in length, 1000 mm in curvature radius in the longitudinal direction, and has a cross-sectional shape identical with that in each case of Example 1 and Example 2 (see FIG. 12). The forming in which strain is relieved was applied to flanges located on both sides of each of the formed part 71 and the formed part 73. The blank material and the hydraulic press machine that are identical with those in each case of Example 1 and Example 2 were used.

Figure 23:
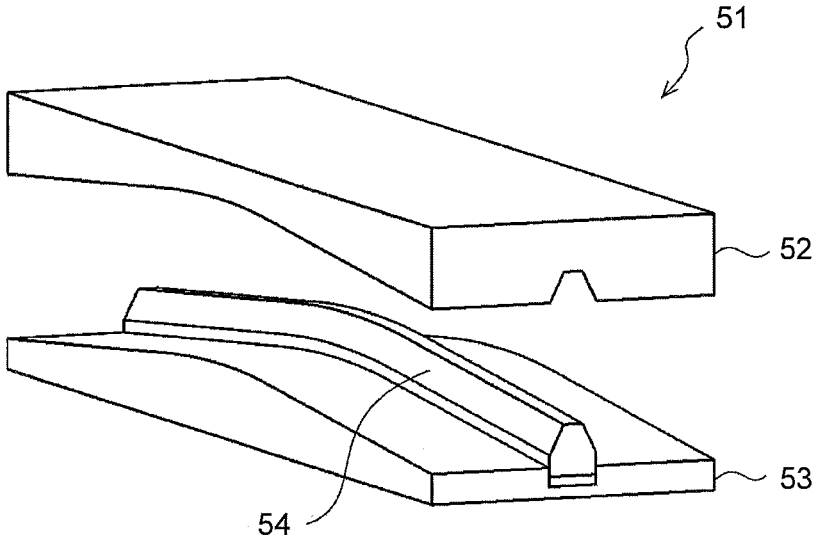
FIGS. 23(*a*) and 23(*b*) are perspective views of respective essential parts of press forming apparatuses according to Example 3 of the present invention.
Figure 23:
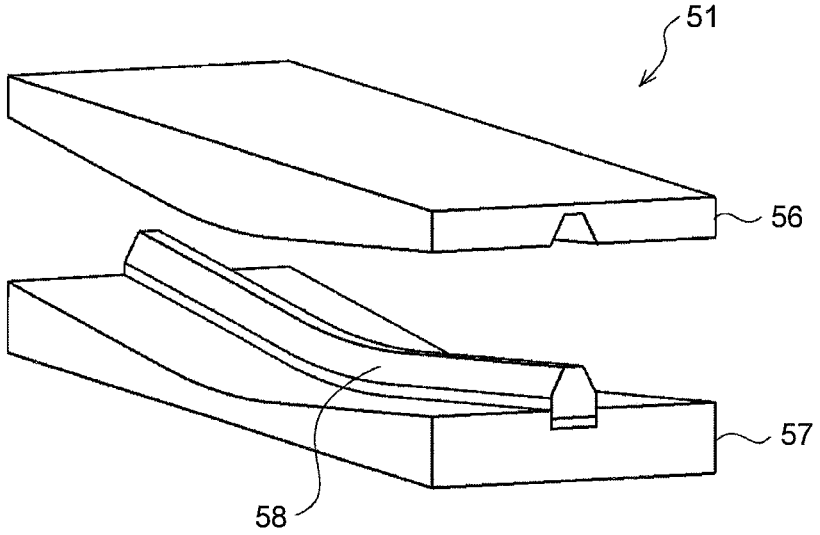
Figure 24:
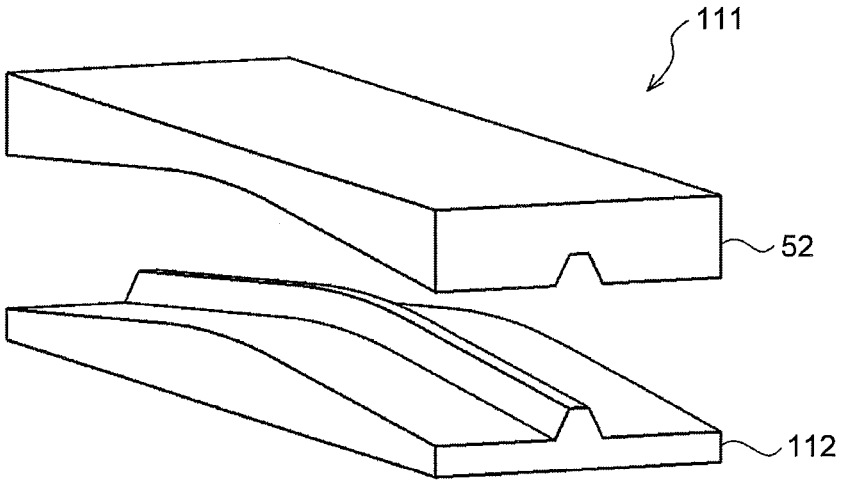
FIGS. 24(*a*) and 24(*b*) are perspective views of respective tools of press forming of conventional press forming apparatuses as comparative examples according to Example 3 of the present invention.
Figure 24:
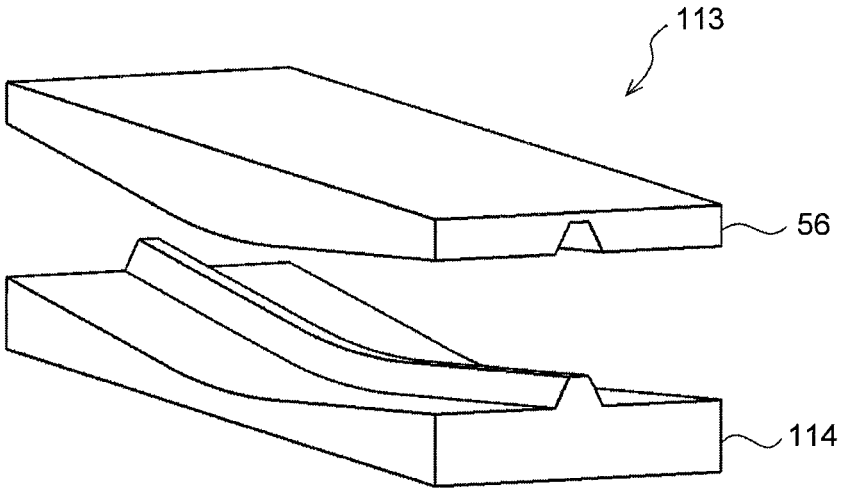

In the present-invention example 20 to the present-invention example 24, a press forming apparatus 51 illustrated in FIG. 23(*a*) was used, and in the present-invention example 25 of to the present-invention example 29, a press forming apparatus 55 illustrated in FIG. 23(*b*) was used. The respective relative moving distances h in the present-invention example 20 to the present-invention example 24 were set to 5, 10, 15, 20, and 25 mm, and the respective relative moving distances h in the present-invention example 25 to the present-invention example 29 were set to 5, 10, 15, 20, and 25 mm. General crash forming using a press forming apparatus 111 (relative moving distance h=0 mm) illustrated in FIG. 24(*a*) was performed as a comparative example 4, and general crash forming using a press forming apparatus 113 (relative moving distance h=0 mm) illustrated in FIG. 24(*b*) was performed as a comparative example 5.

Figure 25:
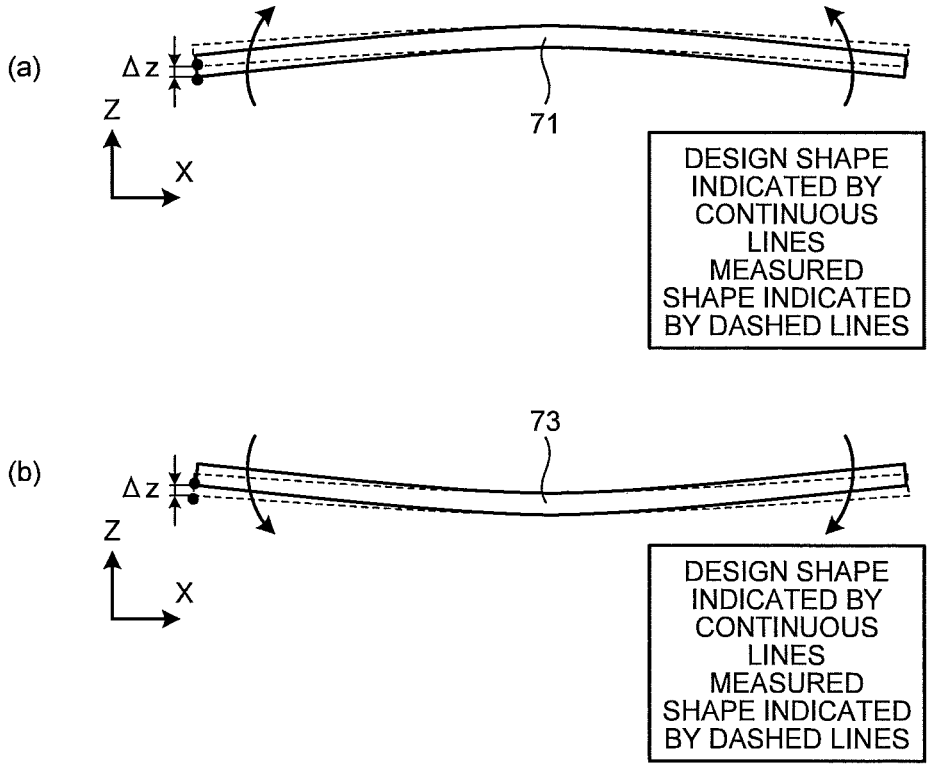
FIGS. 25(*a*) and 25(*b*) are explanatory views of respective methods of evaluations of springback quantities according to Example 3 of the present invention.

As a mode of springback, camber springback in the +z direction occurs, as illustrated in FIG. 25(*a*), in the formed part 71 illustrated in FIG. 22(*a*), and camber springback in the −z direction occurs, as illustrated in FIG. 25(*b*), in the formed part 73 illustrates in FIG. 22(*b*). Difference between measured shape data at the end of the formed part and design shape data in the z direction (camber amount Δz) was calculated, and the camber amount was set to the index of the camber springback due to the springback. The condition that the camber amount Δz is positive implies that the end of the formed part is deformed in a camber springback shape in the upward direction (in the direction toward a side opposite to the flange portion), and the condition that the camber amount Δz is negative implies that the end of the formed part is deformed in a camber springback shape in the downward direction (in the direction toward a flange-portion side). Furthermore, the condition that the absolute value of the camber amount Δz is small implies that the springback is small. Table 3 indicates a convex direction of a product, respective press-forming conditions (relative moving distance h (mm), h/L), and camber amounts Δz (mm) of the formed part 71 and the formed part 73 that are formed under the respective press-forming conditions.

Table 3

| | | Press forming condition | | |
|---|---|---|---|---|
| | Product convex direction | Relative moving distance h (mm) | h/L | Camber amount Δz (mm) |
| Comparative example 4 | Upward | 0 | 0.0 | 13.5 |
| Present-invention example 20 | Upward | 5 | 0.2 | 8.6 |
| Present-invention example 21 | Upward | 10 | 0.4 | 4.0 |
| Present-invention example 22 | Upward | 15 | 0.6 | 2.2 |
| Present-invention example 23 | Upward | 20 | 0.8 | 0.2 |
| Present-invention example 24 | Upward | 25 | 1.0 | −1.0 |
| Comparative example 5 | Downward | 0 | 0.0 | −15.0 |
| Present-invention example 25 | Downward | 5 | 0.2 | −9.2 |
| Present-invention example 26 | Downward | 10 | 0.4 | −5.1 |
| Present-invention example 27 | Downward | 15 | 0.6 | −2.0 |
| Present-invention example 28 | Downward | 20 | 0.8 | −0.4 |
| Present-invention example 29 | Downward | 25 | 1.0 | 0.8 |

In the examples each of which examines the formed part 71 (product formed in an upward convex shape), the forming condition that minimizes a springback quantity (minimizes the absolute value of the camber amount Δz) is indicated in the present-invention example 23 (h=20 mm); that is, Δz=0.2 mm and hence, the springback was considerably decreased compared with the case of the comparative example 4; that is, Δz=13.5 mm. In the examples each of which examines the formed part 73 (product formed in a downward convex shape), the forming condition that minimizes a springback quantity is indicated in the present-invention example 28 (h=20 mm); that is, Δz=−0.4 mm and hence, the springback was considerably decreased compared with the case of the comparative example 5; that is, Δz=−15.0 mm.

As mentioned above, in addition to the case of a product curving in the x-y plane, even when the present invention was applied to the product curving in the z direction (pressing direction), the high springback suppression effect was confirmed.

Although the present invention has been specifically explained in conjunction with the embodiments, the present invention is not limited to the above-mentioned embodiment that merely constitutes one embodiment of the present invention, and various modifications and applications made by, for example, those skilled in the art are arbitrarily conceivable without departing from the gist of the present invention.

INDUSTRIAL APPLICABILITY

According to the present invention, it is possible to provide a method of press forming and a press forming apparatus that are capable of reducing three-dimensional springback, such as torsion or bending, without changing a product shape.

REFERENCE SIGNS LIST

1 press forming apparatus
3 die
3*a* recessed portion
3*b* flange forming portion
5 punch
5*a* side-wall-portion forming surface lowermost end
6 groove wall upper end
7 flange forming die
7*a* punch setting groove
8 support mechanism
9 pad
10 press forming apparatus
11 punch having outer flange forming portion
13 inner flange forming die
15 press forming apparatus
17 punch having inner flange forming portion
19 outer flange forming die
21 press forming apparatus
23 blank
23*a* inner end
23*b* outer end
31 formed part
31*a* punch bottom portion
31*b* side wall portion
31*c* outer flange
31*d* inner flange
41 formed part having a curving flange formed in the inner side thereof
43 formed part having a curving flange formed in the outer side thereof
51 press forming apparatus in the present invention
52 die
53 flange forming die
54 punch
55 press forming apparatus in the present invention
56 die
57 flange forming die
58 punch
71 formed part formed in an upward convex shape
73 formed part formed in a downward convex shape
81 formed part formed in such a manner that only the flange thereof is formed in an upward convex shape
83 formed part formed in such a manner that only the flange thereof is formed in a downward convex shape
101 press forming die
103 die
105 punch
111 press forming die
112 punch
113 press forming die
114 punch

The invention claimed is:

1. A method of press forming a formed part in a blank, the formed part having a product shape that includes a trench-shaped portion extending in a longitudinal direction, the method comprising:

a first forming step of forming in the blank (i) the trench-shaped portion into the product shape with a die and a punch until reaching a first bottom dead center, and (ii) at least one of:

an outer curving flange portion having a large curvature radius, the outer curving flange portion subject to shrink flange deformation such that a linear length of the outer curving flange portion subject to the shrink flange deformation in the longitudinal direction is shorter than a linear length of a flange portion in the product shape; and an inner curving flange portion having a small curvature radius, the inner curving flange portion subject to stretch flange deformation such that a linear length of the inner curving flange portion subject to the stretch flange deformation in the longitudinal direction is longer than the linear length of the flange portion in the product shape; and a second forming step of forming in the blank at least one of the outer curving flange portion and the inner curving flange portion formed in the first forming step into the product shape with the die and a flange forming die until reaching a second bottom dead center, wherein the first forming step and the second forming step are performed by a single press forming process, the single press forming process forming in the blank the formed part in the product shape including the trench-shaped portion extending in the longitudinal direction and the at least one of the outer curving flange portion curving along the longitudinal direction and the inner curving flange portion curving along the longitudinal direction, the at least one of the outer curving flange portion and the inner curving flange portion being on at least one of a pair of side wall portions that constitute the trench-shaped portion.

2. The method of press forming according to claim 1, wherein the second forming step brings the die and the punch close to the flange forming die while the die and the punch hold the trench-shaped portion at the first bottom dead center, in a state that a part of the at least one of the outer curving flange portion and the inner curving flange portion abuts on the flange forming die.

3. The method of press forming according to claim 1, wherein the second forming step stops the die and the punch while the die and the punch hold the trench-shaped portion at the first bottom dead center, and brings the flange forming die close to the die side.

4. The method of press forming according to claim 1, wherein the first forming step and the second forming step are applied to the at least one of the outer curving flange portion and the inner curving flange portion on either one of the pair of side wall portions.

5. The method of press forming according to claim 1, wherein the first forming step and the second forming step are applied to the outer curving flange portion and the inner curving flange portions on the pair of side wall portions.

6. The method of press forming according to claim 1, wherein, when a press-formed part including a punch bottom portion is formed, a part corresponding to the punch bottom portion in the blank is pressed with a pad to perform the first forming step and the second forming step.

7. A press forming apparatus that forms a formed part in a blank, the formed part having a product shape that includes a trench-shaped portion extending in a longitudinal direction, the press forming apparatus comprising:

a die including a recessed portion and flange forming portions on both sides of the recessed portion;

a punch whose upper portion is inserted into the recessed portion of the die; and a flange forming die configured to form in the blank at least one of an outer curving flange portion and an inner curving flange portion in cooperation with the flange forming portions of the die, wherein the punch is set in the flange forming die in a relatively movable manner and supported with a support mechanism so that the punch is configured to move relative to the flange forming die at a time a predetermined pressure is applied to the punch, the punch is supported with the support mechanism at a predetermined height above the flange forming die and in this state, the upper portion of the punch is inserted into the recessed portion of the die to form in the blank the trench-shaped portion and the at least one of:

the outer curving flange portion such that a linear length of the outer curving flange portion is shorter than a linear length of a flange portion in the product shape, and the inner curving flange portion such that a linear length of the inner curving flange portion is longer than the linear length of the flange portion in the product shape, the die is configured to move by a force larger than a support force of the support mechanism that supports the punch while holding the trench-shaped portion with the die and the punch to form in the blank the at least one of the outer curving flange portion and the inner curving flange portion with the die and the flange forming die, such that at least one of the linear length of the outer curving flange portion and the linear length of the inner curving flange portion are restored to of the respective linear length of the at least one of the outer curving flange portion and the inner curving flange portion in the product shape, and the press forming apparatus forms in the blank the formed part in the product shape including the trench-shaped portion extending in the longitudinal direction and at least one of the outer curving flange portion curving along the longitudinal direction and the inner curving flange portion curving along the longitudinal direction, the at least one of the outer curving flange portion and the inner curving flange portion is on at least one of a pair of side wall portions that constitute the trench-shaped portion, with the die, the punch and the flange forming die.

8. A press forming apparatus that forms a formed part in a blank, the formed part having a product shape that includes a trench-shaped portion extending in a longitudinal direction, the press forming apparatus comprising:

a die including a recessed portion and flange forming portions on both sides of the recessed portion;

a punch whose upper portion is inserted into the recessed portion of the die; and a flange forming die configured to form in the blank at least one of an outer curving flange portion and an inner curving flange portion in cooperation with the flange forming portions of the die, wherein the punch is set in the flange forming die in a relatively movable manner and supported with a support mechanism so that the punch is configured to move relative to the flange forming die at a time a predetermined pressure is applied to the punch, the punch is supported with the support mechanism at a predetermined height above the flange forming die and in this state, the upper portion of the punch is inserted into the recessed portion of the die to form in the blank the trench-shaped portion and the at least one of:

the outer curving flange portion such that a linear length of the outer curving flange portion is shorter than a linear length of a flange portion in the product shape, and the inner curving flange portion such that a linear length of the inner curving flange portion is longer than the linear length of the flange portion in the product shape, the flange forming die is moved while holding the trench-shaped portion with the die and the punch to form in the blank the at least one of the outer curving flange portion and the inner curving flange portion with the die and the flange forming die, such that at least one of the linear length of the outer curving flange portion and the linear length of the inner curving flange portion are restored to the respective linear length of the outer curving flange portion and the inner curving flange portion in the product shape, and the press forming apparatus forms in the blank the formed part in the product shape including the trench-shaped portion extending in the longitudinal direction and at least one of the outer curving flange portion curving along the longitudinal direction and the inner curving flange portion curving along the longitudinal direction, the at least one of the outer curving flange portion and the inner curving flange portion is on at least one of a pair of side wall portions that constitute the trench-shaped portion, with the die, the punch and the flange forming die.

9. The press forming apparatus according to claim 7, wherein a relative moving distance of the punch (h) with respect to the flange forming die is defined by the following expression:

$$0.05 \times L < h < 1.0 \times L$$

where L indicates a flange width of the product shape.

10. The press forming apparatus according to claim 7, wherein the flange forming die forms the at least one of the outer curving flange portion and the inner curving flange portion on either one of the pair of side wall portions.

11. The press forming apparatus according to claim 7, wherein the flange forming die forms the outer curving flange portion and the inner curving flange portions on the pair of side wall portions.

12. The press forming apparatus according to claim 7, wherein the press forming apparatus includes a pad that sandwiches a part of the blank in cooperation with the punch.

13. The press forming apparatus according to claim 8, wherein a relative moving distance of the punch (h) with respect to the flange forming die is defined by the following expression:

$$0.05 \times L < h < 1.0 \times L$$

where L indicates a flange width of the product shape.

14. The press forming apparatus according to claim 8, wherein the flange forming die forms at least one of the outer curving flange portion and the inner curving flange portion on either one of the pair of side wall portions.

15. The press forming apparatus according to claim 8, wherein the flange forming die forms the outer curving flange portion and the inner curving flange portions on the pair of side wall portions.

16. The press forming apparatus according to claim 8, wherein the press forming apparatus includes a pad that sandwiches a part of the blank in cooperation with the punch.

* * * * *